US005895143A

United States Patent [19]

Kawahara et al.

[11] Patent Number: 5,895,143

[45] Date of Patent: Apr. 20, 1999

[54] ELECTROPHOTOGRAPHIC IMAGE-FORMING APPARATUS

[75] Inventors: Morihisa Kawahara; Hiroyuki Kawai, both of Kawasaki, Japan

[73] Assignee: Fujitsu Limited, Kanagawa, Japan

[21] Appl. No.: 08/956,080

[22] Filed: Oct. 22, 1997

Related U.S. Application Data

[62] Division of application No. 08/678,746, Jul. 11, 1996, Pat. No. 5,835,822.

[30] Foreign Application Priority Data

Sep. 19, 1995 [JP] Japan ..... 7-240048

[51] Int. Cl.[6] ..... G03G 15/00; G03G 15/20

[52] U.S. Cl. ..... 399/88; 399/122

[58] Field of Search ..... 399/37, 88, 90, 399/122, 320, 359, 110; 219/216

[56] References Cited

U.S. PATENT DOCUMENTS

| | | | |
|---|---|---|---|
| 4,894,688 | 1/1990 | Taniguchi et al. | 399/359 |
| 4,937,628 | 6/1990 | Cipolla | 399/106 |
| 4,954,404 | 9/1990 | Inoue et al. | 430/45 |
| 5,078,303 | 1/1992 | Kikuchi et al. | 222/167 |
| 5,126,799 | 6/1992 | Matsuura et al. | 399/110 |
| 5,223,893 | 6/1993 | Ikemoto et al. | 399/111 |
| 5,306,381 | 4/1994 | Nakazawa et al. | 399/69 |
| 5,467,176 | 11/1995 | Watanuki et al. | 399/149 |
| 5,485,244 | 1/1996 | Gotoda et al. | 399/111 |
| 5,506,665 | 4/1996 | Ishida et al. | 399/119 |
| 5,581,328 | 12/1996 | Yashiro | 399/111 |
| 5,682,580 | 10/1997 | Iwama et al. | 399/320 X |

FOREIGN PATENT DOCUMENTS

| | | |
|---|---|---|
| 0 656 570 | 6/1995 | European Pat. Off. . |
| 3427919 | 2/1985 | Germany . |
| 41 21 296 | 4/1992 | Germany . |
| 1-271329 | 10/1989 | Japan . |
| 5-19554 | 1/1993 | Japan . |

*Primary Examiner*—Arthur T. Grimley
*Assistant Examiner*—Sophia S. Chen
*Attorney, Agent, or Firm*—Nikaido Marmelstein Murray & Oram, LLP

[57] ABSTRACT

An electrophotographic image forming apparatus includes an electrostatic latent image carrying body, an electric charger for uniformly electrifying the carrying body, an optical exposure unit to form an electrostatic latent image on the carrying body, a developer for developing the electrostatic latent image to form a toner image on the carrying body, a transfer unit for transferring the toner image from the carrying body onto a printing sheet, a fixing unit for fixing the toner image to the printing sheet, a cleaner for cleaning to remove residual toner from the carrying body and a toner returning mechanism for returning the residual toner removed by the cleaner to the developer. The developer includes a housing in which a toner chamber is defined, a developing roller rotatably mounted in the housing, an agitator rotatably mounted in the housing so as to be positioned in the toner chamber, a partitioning member provided in the housing for defining a carrier chamber adjacent to the developing roller. The toner returning mechanism includes a toner recirculator for recirculating the residual toner removed from the carrying body to the toner chamber.

2 Claims, 38 Drawing Sheets

ELECTROPHOTOGRAPHIC IMAGE-FORMING APPARATUS

This application is a Division of Ser. No. 08/678,746 filed on Jul. 11, 1996, now U.S. Pat. No. 5,835,822.

BACKGROUND OF THE INVENTION

1. Field of the Invention

The present invention relates to electrophotographic image-forming apparatuses such as laser beam printers or LED printers.

Due to recent developments in office automation, electrophotographic image-forming apparatuses, such as laser beam printers, have been widely used in computer output terminals, copying machines, facsimile machines and others.

In such image-forming apparatuses, a hard copy is obtained by the steps of charging a photosensitive drum to a predetermined potential by a charger, forming an electrostatic latent image corresponding to an image information on the photosensitive drum by irradiating a light beam thereon, developing the latent image with a toner, transferring the developed image to a recording medium, and fixing the same.

After the transfer step, the photosensitive drum is discharged by a discharger, and the residual toner is scraped off from the surface of the photosensitive drum by a cleaner, thus one cycle of the printing operation is completed on the photosensitive drum.

2. Related Art

A so-called "one component and a half" development has been known for developing the electrostatic latent image on the photosensitive drum, wherein a magnetic carrier is stored in a carrier chamber or a development chamber which is then replenished with a toner.

This method provides a development device simple in structure because no control is necessary for a toner density. However, to maintain a favorable image quality, means is necessary for maintaining the toner density at a constant value.

Also a structure has been known for recycling the residual toner scraped off from the photosensitive drum by the cleaner and returning the same to a toner box through a toner recycling mechanism for the purpose of reuse. A development device with such a recycling mechanism is advantageous because the residual toner is not discharged as waste whereby the efficiency for reusing the toner is improved.

According to the conventional toner recycling mechanism, however, since the residual toner must be returned to the toner box mounted above the development device, it is necessary to convey the residual toner obliquely upward. Thereby, there is a problem in that the residual toner is liable to dwell on the bottom of the cleaner housing, resulting in the lowering of the toner reuse efficiency.

In addition, if foreign matter such as paper chips or dust are mixed in the residual toner, they may be conveyed to a developer roller and nipped between a doctor blade and the developer roller. As a result, there is a problem in that the conveyance of the developing agent is impeded at a location where the foreign matters are nipped, whereby an incomplete printing may occur at a portion corresponding to this location.

In a device for carrying out the "one component and a half" development, a carrier chamber for storing a toner is defined between a developer roller and a partitioning member. When the developer roller rotates, the toner is supplied from a toner chamber to the carrier chamber in which the toner is mixed with the carrier and charged at a predetermined potential level.

However, in the conventional carrier chamber, since a distance between the partitioning member and the developer roller becomes gradually smaller near the ends thereof, there is a tendency that the developing agent moves from the end zones to the central zone whereby the amount of carrier is reduced in the end zones.

In such a case, the toner density becomes higher in the end zones because the toner supply from the toner chamber is uniform along the axis of the developer roller, resulting in the unevenness in the toner density. The unevenness in the toner density causes the deterioration of qualities of the printed image, such as shade irregularity or fog.

SUMMARY OF THE INVENTION

Accordingly, an object of the present invention is to provide an electrophotographic image-forming apparatus which is free from erroneous paper supply and has a paper-supply/conveyance part improved in durability.

Another object of the present invention is to provide an electrophotographic image-forming apparatus having an improved toner reuse efficiency.

A further object of the present invention is to provide an electrophotographic image-forming apparatus capable of preventing the deterioration of qualities of the printed image, such as shade irregularity or fog, and of being easily assembled and maintained.

According to the present invention, there is provided an electrophotographic image forming apparatus comprising: an electrostatic latent image carrying body; means for uniformly electrifying the carrying body; means for conducting an optical exposure on the carrying body to form an electrostatic latent image thereon; means for developing the electrostatic latent image to form a toner image on the carrying body; means for transferring the toner image from the carrying body onto a printing sheet; means for fixing the toner image to the printing sheet; means for cleaning to remove residual toner from the carrying body; means for returning the residual toner removed by the cleaning means to the developing means; means for supplying the printing sheet from a hopper and transporting the same through the transferring means and the fixing means; and the supplying and transporting means comprising:

a pick roller arranged at an upper front side of the hopper for picking up a printing sheet from a stack of printing sheets in the hopper in a transporting direction; a pressure plate for pushing the stack of printing sheets toward the pick roller; and an end guide means for pushing a rear end of the stack of printing sheets toward the transporting direction in cooperation with the pressure plate.

In another aspect of the present invention, there is provided an electrophotographic image forming apparatus comprising: an electrostatic latent image carrying body; means for uniformly electrifying the carrying body; means for conducting an optical exposure on the carrying body to form an electrostatic latent image thereon; means for developing the electrostatic latent image to form a toner image on the carrying body; means for transferring the toner image from the carrying body onto a printing sheet; means for fixing the toner image to the printing sheet; means for cleaning to remove residual toner from the carrying body; means for returning the residual toner removed by the cleaning means to the developing means; means for supplying the printing sheet from a hopper and transporting the same through the transferring means and the fixing means; and the supplying and transporting means comprising:

a pick roller arranged at an upper front side of the hopper for picking up a printing sheet from a stack of printing sheets in the hopper in a transporting direction; means for pushing the stack of printing sheets toward the pick roller; a friction separating pad arranged to be in contact with the pick roller for separating a first, uppermost sheet from remaining sheets of the stack; and a means for controlling the pick roller in such a manner that, after the first sheet is fed forward by the pick roller to a position in which a front end thereof slightly exceeds the friction separating pad, the first sheet is stopped until a next printing operation is started.

In further aspect of the present invention, there is provided an electrophotographic image forming apparatus comprising: an apparatus body; an electrostatic latent image carrying body; means for uniformly electrifying the carrying body; means for conducting an optical exposure on the carrying body to form an electrostatic latent image thereon; means for developing the electrostatic latent image to form a toner image on the carrying body; means for transferring the toner image from the carrying body onto a printing sheet; means for fixing the toner image to the printing sheet; means for cleaning to remove residual toner from the carrying body; means for returning the residual toner removed by the cleaning means to the developing means; means for supplying the printing sheet from a hopper and transporting the same through the transferring means and the fixing means; and a process unit detachably mounted on the apparatus body and accommodating therein at least the electrostatic latent image carrying body, the electrifying means, the exposure means, the cleaning means and the toner returning means.

In a still further aspect of the present invention, there is provided an electrophotographic image forming apparatus comprising: an electrostatic latent image carrying drum; means for conducting an optical exposure on the carrying body to form[]an electrostatic latent image thereon; means for developing the electrostatic latent image to form a toner image on the carrying body; means for transferring the toner image from the carrying body onto a printing sheet; means for fixing the toner image to the printing sheet; means for cleaning to remove residual toner from the carrying body; means for returning the residual toner removed by the cleaning means to the developing means; and the electrifying means comprising a discharging wire and a corona discharger having a grid electrode having a first surface opposite to the discharging wire and a second surface opposite to the image carrying drum, the second surface being provided with a plurality of openings arranged in an axial direction and a rotating direction of the image carrying drum and the openings being offset in the rotating direction of the image carrying drum.

In a still further aspect of the present invention, there is provided an electrophotographic image forming apparatus comprising: an electrostatic latent image carrying drum; means for conducting an optical exposure on the carrying body to form an electrostatic latent image thereon; means for developing the electrostatic latent image to form a toner image on the carrying body; means for transferring the toner image from the carrying body onto a printing sheet; means for fixing the toner image to the printing sheet; means for cleaning to remove residual toner from the carrying body; means for returning the residual toner removed by the cleaning means to the developing means; and a power source of the apparatus, the power source being a single unit with the fixing means.

In still another aspect of the present invention, there is provided a process unit adapted to be used in an electrophotographic image forming apparatus, the process unit comprising: an electrostatic latent image carrying body; means for uniformly electrifying the carrying body; means for conducting an optical exposure on the carrying body to form an electrostatic latent image thereon; means for developing the electrostatic latent image to form a toner image on the carrying body; means for cleaning to remove residual toner from the carrying body; means for returning the residual toner removed by the cleaning means to the developing means;

the developing means comprising: a housing in which a toner chamber is defined; a developing roller rotatably mounted in the housing; an agitator rotatably mounted in the housing so as to be positioned in the toner chamber; a partitioning member provided in the housing for defining a carrier chamber adjacent to the developing roller; and the toner returning means comprising means for recirculating the residual toner removed from the carrying body to the toner chamber of the developing means.

In a still further aspect of the present inventions there is provided a process unit adapted to be used in an electrophotographic image forming apparatus, the process unit comprising: an electrostatic latent image carrying body; means for uniformly electrifying the carrying body; means for conducting an optical exposure on the carrying body to form an electrostatic latent image thereon; means for developing the electrostatic latent image to form a toner image on the carrying body; means for cleaning to remove residual toner from the carrying body; means for returning the residual toner removed by the cleaning means to the developing means;

the electrifying means comprising a discharging wire and a corona discharger having a grid electrode having a first surface opposite to the discharging wire and a second surface opposite to the image carrying drum, the second surface being provided with a plurality of openings arranged in an axial direction and a rotating direction of the image carrying drum and the openings being offset in the rotating direction of the image carrying drum.

BRIEF DESCRIPTION OF THE DRAWINGS

The present invention will be described in more detail with reference to the attached drawings illustrating the preferred embodiments; wherein

FIGS. 17(A), 17(B) through FIGS. 21(A), (B) are the illustrations of shapes of other partitioning members;

DESCRIPTION OF THE PREFERRED EMBODIMENTS

Figure 1:
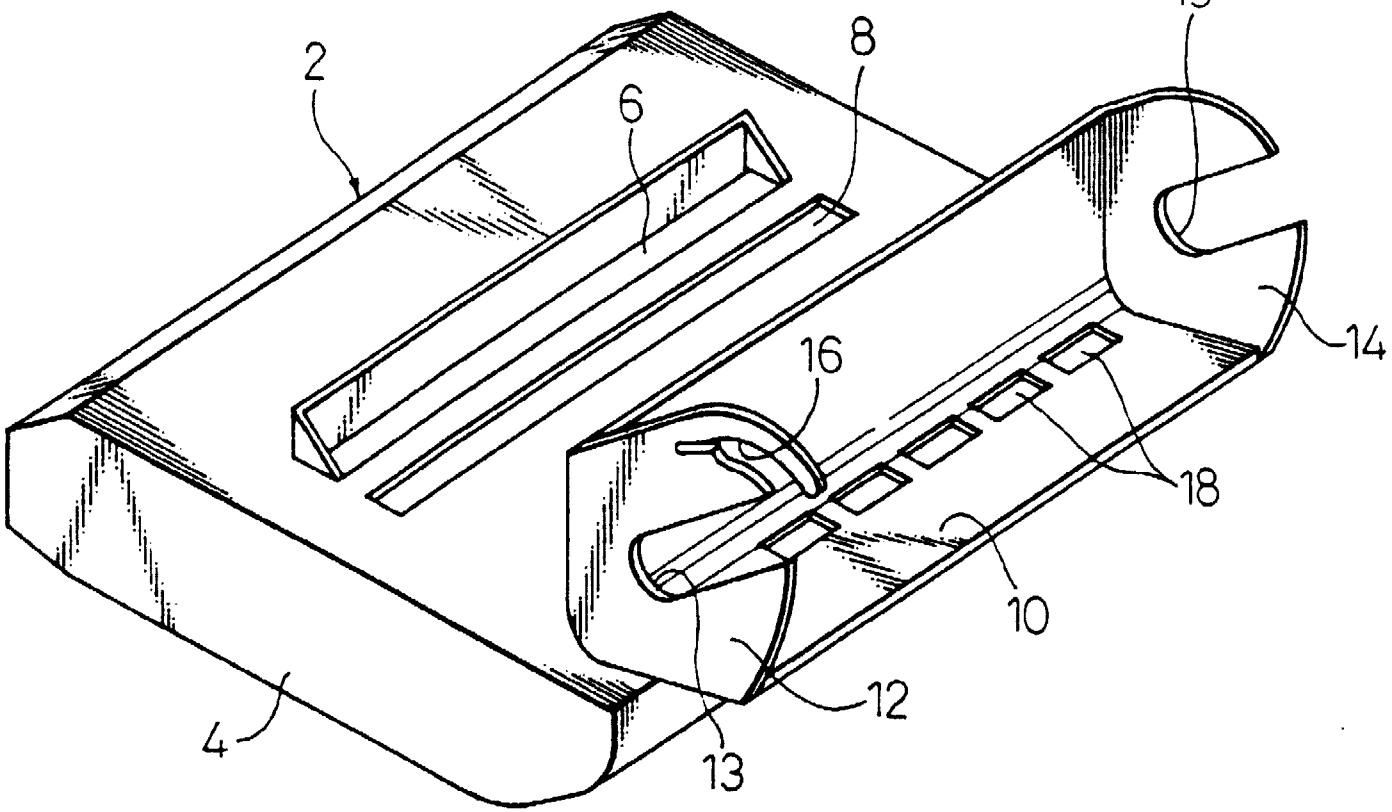
FIG. 1 is a perspective view of a process unit.
Figure 2:
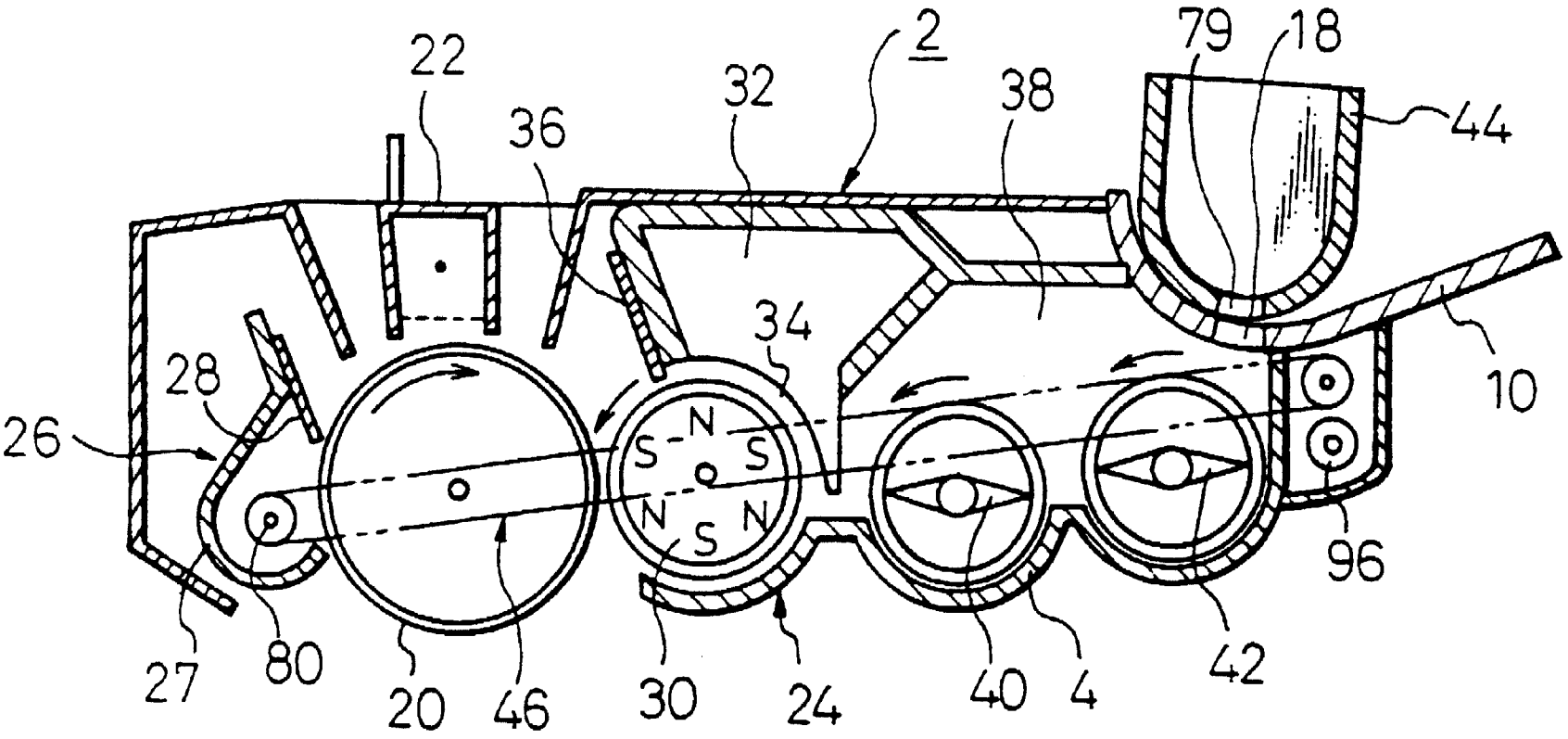
FIG. 2 is a sectional view of the process unit.

FIGS. 1 and 2 illustrate a perspective view and a sectional view, respectively, of a process unit according to one embodiment of the present invention. The process unit 2 is a structure wherein a photosensitive drum 20, a development device 24 and a cleaner 26 are combined in an integral manner, to be detachable as a single unit from a printer.

A housing 4 of the process unit 2 has an opening 6 for mounting a corona charger 22 and an opening 8 for exposing the photosensitive drum 20 by an optical unit.

A toner cartridge receiving member 10 is structured by a pair of side panels 12, 14, on which are provided guide slots 13, 15, respectively, for guiding a toner cartridge when the same is mounted to the receiving member 10.

The side panel 12 also has a slot 16 for allowing the rotation of the toner cartridge mounted to the receiving member 10. A plurality of toner supplying openings 18 are formed on the bottom of the receiving member 10.

With reference to FIG. 2, the corona charger 22 is mounted into the opening 6 of the housing 4 of the process unit 2. The development device 24 includes a developer roller 30 rotatable in the arrowed direction and a carrier chamber or a development chamber 34 defined between the developer roller 30 and a partitioning member 32 attached to the housing 4. The carrier chamber 34 stores therein a developing agent consisting of a carrier and a toner. A doctor blade 36 is provided for controlling a thickness of a layer of the developing agent stick to the developer roller 30.

A toner chamber 38 is provided, for storing the toner therein, in which are rotatably mounted first and second agitators 40, 42 for mixing the toner stored in the toner chamber 38.

The cartridge 44 is detachably mounted to the cartridge receiving member 10. The cleaner 26 has a blade 28 which is in contact with the photosensitive drum 20 to scrape off the residual toner therefrom.

A toner recycling mechanism for returning the residual toner stored in a housing 27 of the cleaner 26 to the toner chamber 38 of the development device 24. Details of the toner recycling mechanism 46 will be described later.

Figure 3:
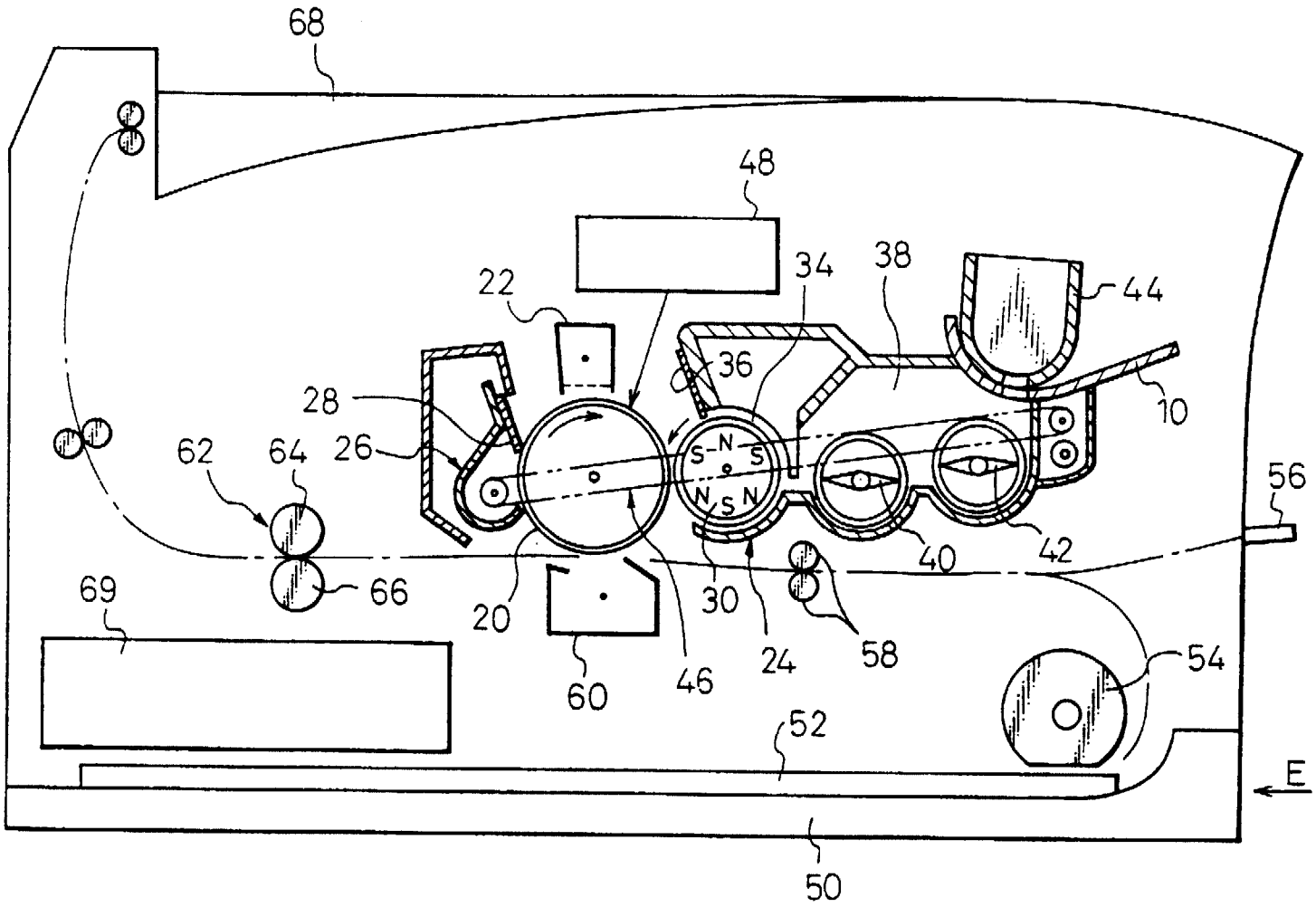
FIG. 3 is the illustration of an overall structure of an electrophotographic image-forming apparatus.

In FIG. 3, a structure of a printer according to the present invention is diagrammatically illustrated. The photosensitive drum 20 is formed by providing a double-layered photoconductive structure, 20 μm thick, on an aluminum drum of 24 mm diameter, and rotates in the arrowed direction at a peripheral speed of 25 mm/sec. The corona charger 22 is a scorotron charger capable of uniformly charging the surface of the photosensitive drum 20 to a potential of about −600V.

The optical unit 48 is operative to form an electro-static latent image on the uniformly charged photosensitive drum 20 by the image exposure. According to this embodiment, a semiconductor laser unit is adopted as the optical unit. An electrostatic latent image as a potential in a range between −50V and −100V is formed on the photosensitive drum 20 by exposing the same in accordance with the image pattern.

The electrostatic latent image is developed by the development device 24 with the developer roller 30 to form a toner image on the photosensitive drum 20. The developer roller 30 is structured by a magnetic roller with a plurality of magnetic poles and a sleeve rotatable on the magnetic roller.

A toner supplied from the toner cartridge 44 and a residual toner recycled from the toner recycling mechanism 46 are supplied into the toner chamber 38, and the toners are uniformly mixed with each other by the rotation of the agitators 40 and 42.

The carrier chamber 34 accommodates a predetermined amount of carrier therein, and the toner is delivered from the toner chamber 38 into the carrier chamber 34 so that a toner density in the carrier chamber 34 is maintained generally constant.

A layer thickness of the developing agent on the developer roller 30 is controlled by the doctor blade 36 so that a magnetic brush is formed on the developer roller 30. When this magnetic brush touches the electro-static latent image on the photosensitive drum 20*e* the latent image is developed to be a toner image.

A paper 52 accommodated in a paper cassette 50 is taken out therefrom by the rotation of a pick roller 54 and conveyed to a transfer charger 60 after the timing thereof is adjusted to be matched with the toner image on the photosensitive drum 20. In this regard, a manual paper tray 56 is also provided.

The toner image on the photosensitive drum 20 is electrostatically transferred to the paper 52 by the operation of the transfer charger 60. The toner image transferred to the paper 52 is fixed by a fixing device 62 consisting of a heat roll 64 and a backup roll 66. Thereafter, the paper carrying the fixed image is discharged to a stacker 68.

The residual toner on the photosensitive drum 20 is scraped off therefrom by the blade 28 of the cleaner 26 and returned to the toner chamber 38 through the toner recycling mechanism 46. A printed circuit board 69 carries a control circuit for the printer thereon.

As the toner is consumed by the developing operation, the toner amount in the carrier chamber 34 reduces to minimize the volume of the developing agent consisting of a carrier and a toner. Then, an amount of the toner stored in the toner chamber 38, corresponding to the consumed amount, is replenished to the carrier chamber 34 by the rotation of the agitators 40 and 42 so that the toner density in the carrier chamber 34 is maintained constant. The agitators 40 and 42 correct the axial distribution of the toner in the toner chamber 38.

When the toner becomes low in the toner chamber 38 due to the exhaustion of the toner, this state is detected by a toner sensor not shown and indicated on a display of the printer. Then, the operator removes the exhausted toner cartridge from the development device 24 and instead mounts a fresh toner cartridge 44 filled with the toner onto the development device 24 to replenish the toner in the toner chamber 38.

Figure 4A:
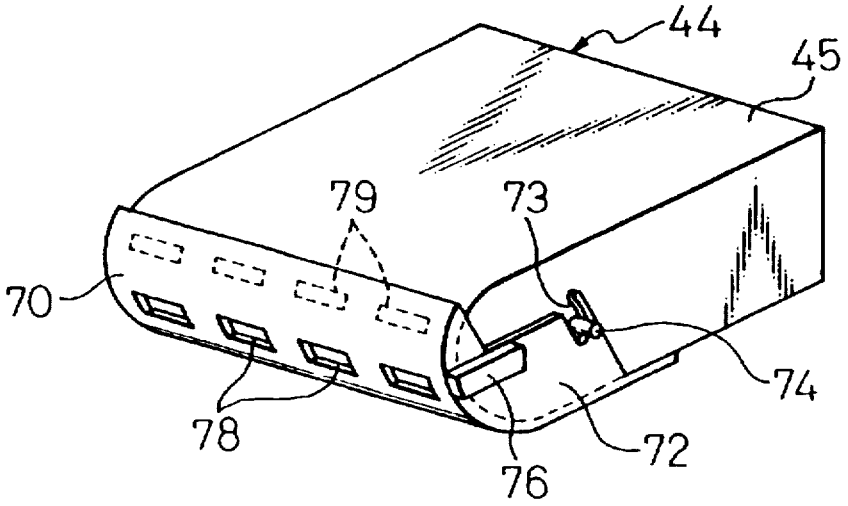
FIGS. 4(A) and 4(B) are perspective views of a toner cartridge.

The structure and the mounting of the toner cartridge will be explained with reference to FIGS. 4(A) and (B). As shown in FIG. 4(A), the toner cartridge 44 is formed of a cartridge base 70 having a generally J-shaped cross-section and a cartridge body 45 to be rotatably mounted to the cartridge base 70.

Each of the side panels 72 of the cartridge base 70 has a rib 76 to be engageable with the guide slot 13 (15) formed on the side panel 12 (14) of the cartridge receiving member 10 shown in FIG. 1. A plurality of openings 78 are provided on the bottom of the cartridge base 70, corresponding to the toner supply openings 18 on the receiving member 10.

On one of the side panels 72 of the cartridge base 70 is provided a groove 73 to be engageable with a pin 74 projected from the cartridge body 45. The cartridge body 45 has a plurality of openings 79 to be aligned with a plurality of openings 78 of the cartridge base 70.

As shown in FIG. 4(A), the cartridge body 45 is integrally assembled with the cartridge base 70 by fitting the pin 74 into the groove 73 of the cartridge base 70.

Figure 4B:
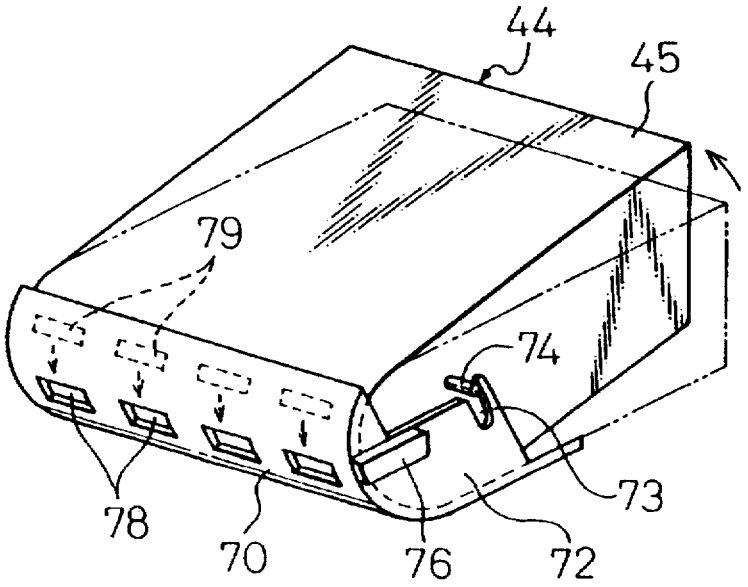

Under a condition wherein the ribs 76 are fully inserted into the guide slots 13, 15 of the cartridge receiving member 10, the cartridge body 45 is rotated relative to the cartridge base 70, as shown in FIG. 4(B).

Figure 5:
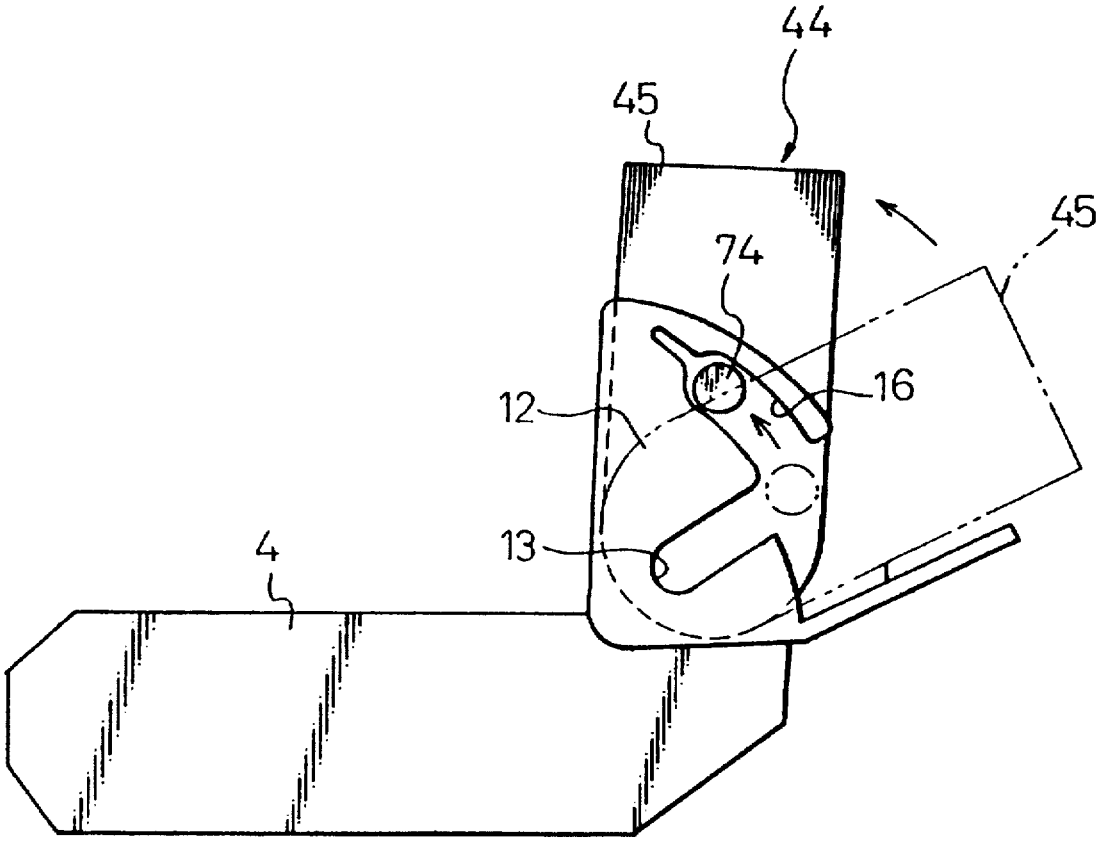
FIG. 5 is a side view of the toner cartridge, illustrating a mounting operation thereof.

Thereby, the pin 74 of the cartridge body 45 escapes from the groove 73 of the cartridge base 70 and is fitted to the groove 16 of the cartridge receiving member 10, and thereafter, is locked therein at a position shown in FIG. 5.

In this state, the openings 79 on the cartridge body 45 are aligned with the toner supply openings 18 on the receiving member 10 so that the toner stored in the toner cartridge 44 can be supplied to the toner chamber 38.

Figure 6:
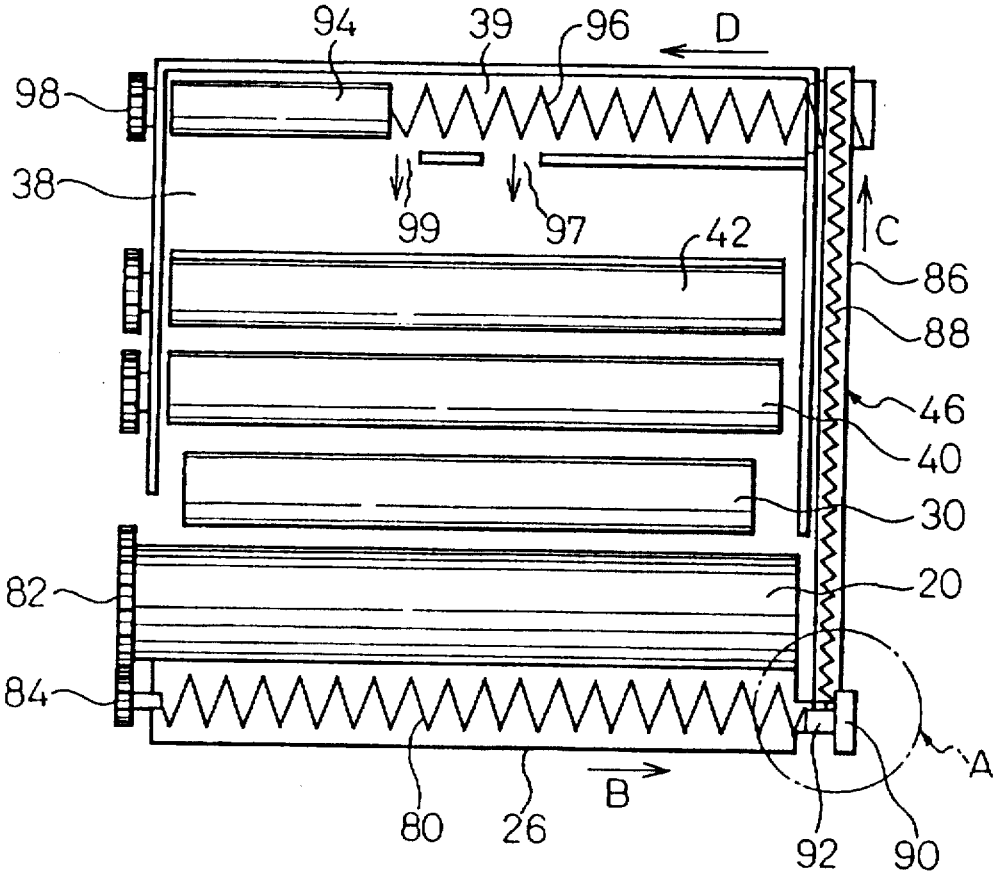
FIG. 6 is a plan view of a toner recycling mechanism.

Details of the toner recycling mechanism 46 will be described with reference to FIG. 6. A coil member 80 is accommodated in the cleaner 26 while being coupled to a gear 84 at one end and to a helical gear 90 at the other end.

Figure 7:
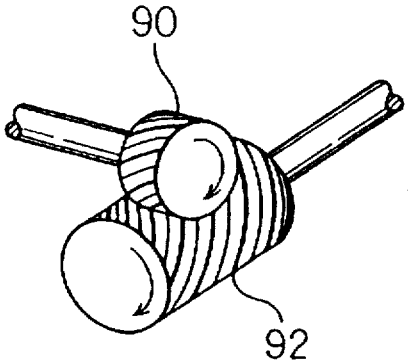
FIG. 7 is a detailed illustration of part A in FIG. 6.

The toner recycling mechanism includes a flexible tube 86 such as a rubber hose and a coil member 88 accommodated in the flexible tube 86. As shown in FIG. 7, one end of the coil member 88 is coupled to a helical gear 92 meshed with the helical gear 90. In a toner returning chamber 39 adjacent to the toner chamber 38 are accommodated a shaft 94 coupled to a gear 98 and a coil member 96 coupled to the shaft 94.

When the gear 84, meshed with a gear 82 for driving the photosensitive drum 20, rotates, the coil member 80 also rotates to convey the residual toner in the cleaner 26 in the arrowed direction B. The rotation of the coil member 80 is transmitted to the coil member 88 accommodated in the flexible tube 86 via the gears 90 and 92 to rotate the coil member 88 so that the residual toner is conveyed in the arrowed direction C.

On the other hand, the coil member 96 rotates via the gear 98 to convey the residual toner collected in the toner returning chamber 39 in the arrowed direction D and supplies the same to the toner chamber 38 through openings 97 and 99 provided in a widthwise central zone of a back plate defining the toner chamber 38.

According to the toner recycling mechanism of this embodiment, since the residual toner accommodated in the cleaner 26 is returned to the widthwise central zone of the toner chamber 38, it is possible to uniformly mix the toner supplied from the toner cartridge 44, with the residual toner, by the rotation of the agitator 42.

Figure 8:
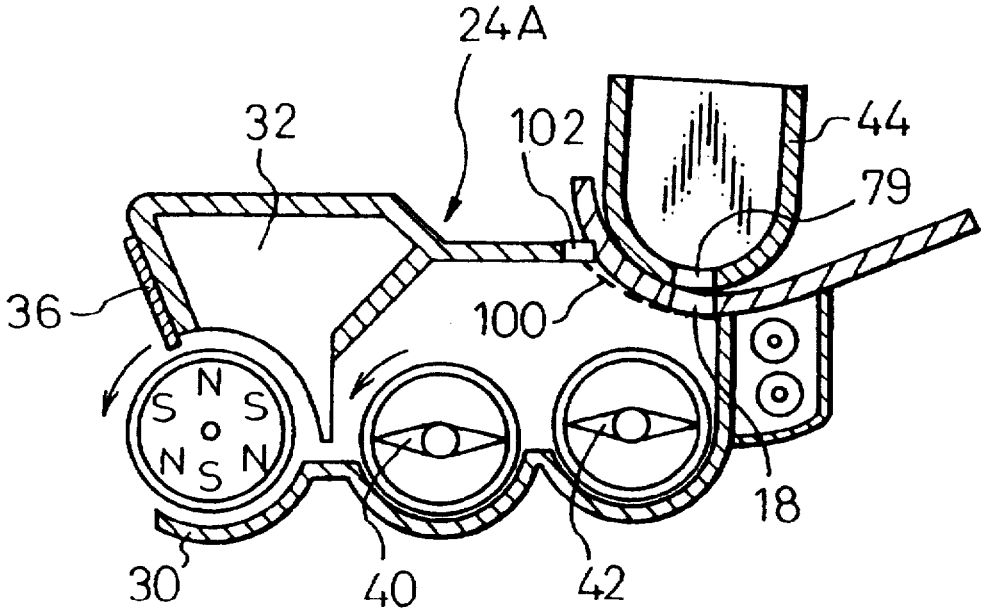
FIG. 8 is a sectional view of a development device according to a second embodiment of the present invention.

FIG. 8 illustrates a sectional view of a development device 24A of a second embodiment according to the present invention. In this embodiment, a dust-prevention member 100 is mounted to the toner supplying opening 18.

Concretely, the dust-prevention member 100 is formed of a net woven while using nylon yarns as warp and weft at a yarn density of 14 end/inch, and attached to the edges of the toner supplying opening 18 by an adhesive.

More specifically, it is necessary to remove the exhausted toner cartridge 44 from the development device when the fresh cartridge is replaced therewith, whereby the toner supplying opening 18 is exposed if no net is provided. Under the circumstance, there may be a risk of invasion of foreign matter into the toner chamber 38, such as human hair, eraser powder, fibers from clothes or paper chips. To avoid such an inconvenience, the net 100 is attached to cover the toner supplying opening 18.

The toner supply is liable to be interrupted if the fluidity of the toner is poor or the apparatus is used in the high temperature environment or if the mesh size of the net 100 is too fine. To solve such a problem, a vibration mechanism 102 is provided for vibrating the net 100.

Figure 9:
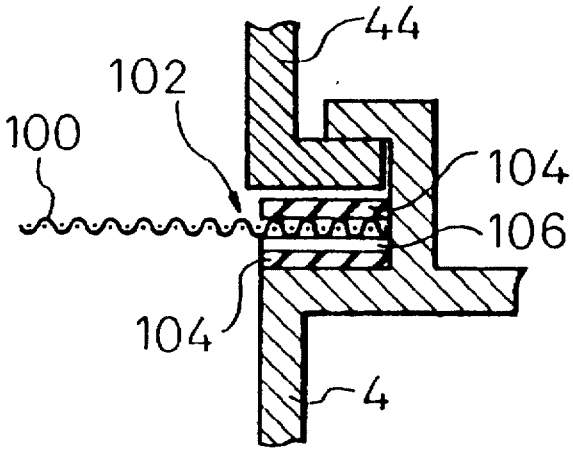
FIG. 9 is a sectional view of a vibration mechanism for a dust removal net.

With reference to FIG. 9, the vibration mechanism 100 for the dust-prevention net 102 will be explained.

A pair of sponge cushions 104 are provided along the outer periphery of the toner supply opening 18 while the dust-prevention net 100 is sandwiched between the two sponge cushions 104, and a plurality of piezo oscillators 106 are arranged along the outer periphery of the toner supply opening 18 and fixedly secured between the lower sponge cushion 104 and the net 100 by an adhesive to vibrate the dust-prevention net 100. Thus it is possible to smoothly supply the toner into the toner chamber 38 by vibrating the net 100 when required.

Figure 10:
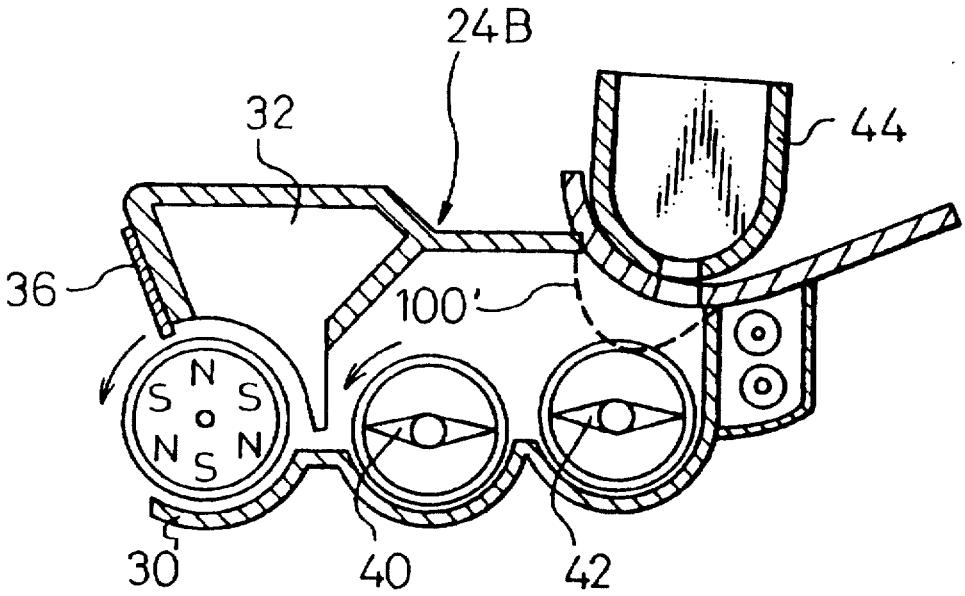
FIG. 10 is a sectional view of a development device according to a third embodiment of the present invention.

FIG. 10 shows a development device 24B according to a third embodiment of the present invention. In this embodiment, a dust-prevention net 100' is provided to interfere with a rotation path of the agitator 42 so that the vibration is imparted to the net 100' by the rotation of the agitator 42.

Figure 11:
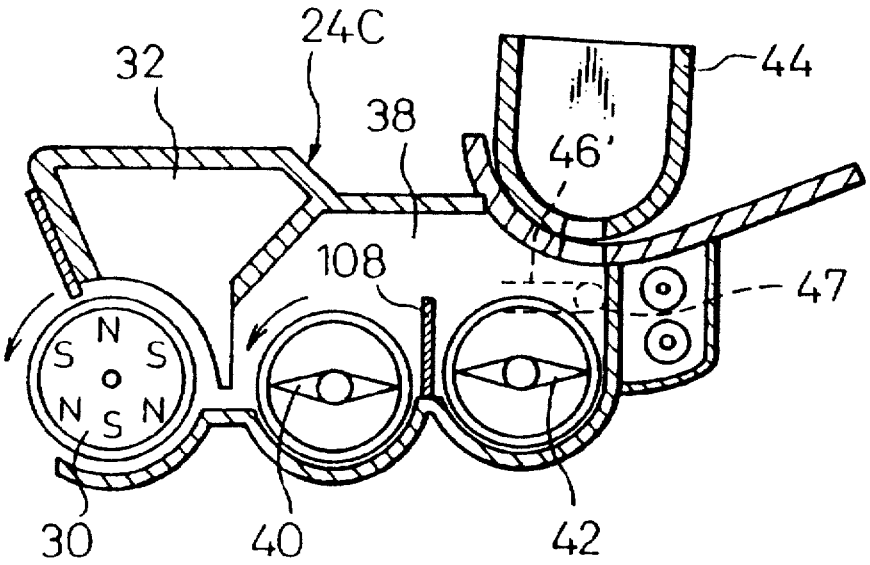
FIG. 11 is a sectional view of a development device according to a fourth embodiment of the present invention.

FIG. 11 illustrates a development device 24C according to a fourth embodiment of the present invention. In this embodiment, a returning end 47 of a toner recycling mechanism 46' opens into a side panel defining a toner chamber 38. Also, a dust-prevention net 108 is provided between a first agitator 40 and a second agitator 42.

In the residual toner returned through the toner recycling mechanism 46', foreign matters, such as paper chips, dusts or large toner particles, are often mixed, which may cause incomplete printing if they are sent to a developer roller 30.

According to this embodiment, the foreign matters in the residual toner are inhibited from being conveyed to the developer roller 30, which enables favorable development with no incomplete printing.

Figure 12A:
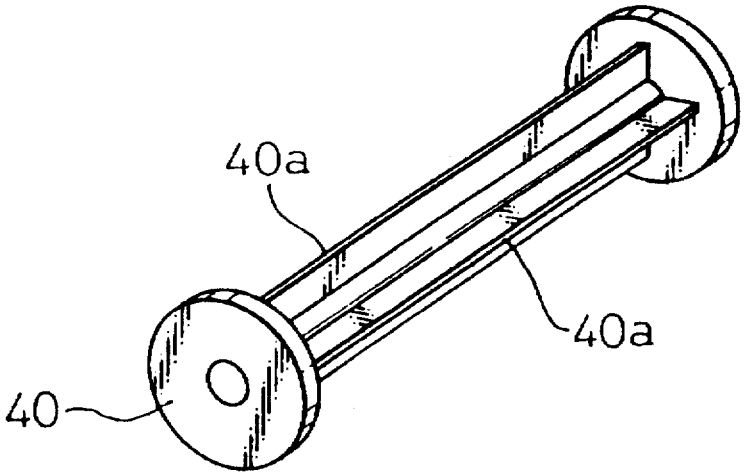
FIGS. 12(A) and 12(B) are perspective views of agitators.
Figure 12B:
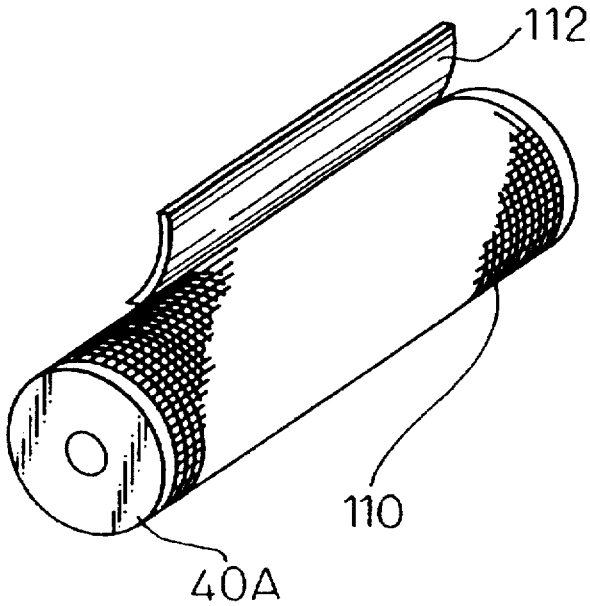

FIG. 12(A) shows a usual agitator 40 having a plurality of blades 40*a*. FIG. 12(B) shows another agitator 40A covered with a dust-prevention net 110 pressed onto the outer periphery of an agitator body by a blade 112. The foreign matter such as large toner particles or dust left on the net 110 are prevented by the blade 112 from being conveyed to a developer roller 30.

Figure 13A:
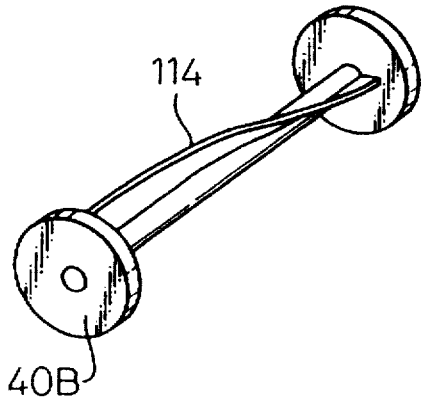
FIGS. 13(A) and 13(B) are perspective views of other agitators.

FIGS. 13(A) and (B) show further examples of agitators. The agitator 40B in FIG. 13(A) has a skewed blade 114. When the agitator 40B rotates, the blade 114 generates a force for moving the toner in the axial direction, whereby the axial distribution of the toner can be uniformly and rapidly conducted.

Figure 13B:
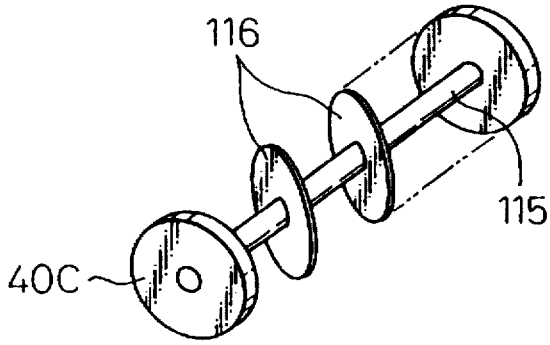

The agitator 40C shown in FIG. 13(B) has a plurality of blades 116 disposed obliquely to an axis 115. The agitator 40C imparts the axial force to the toner similarly to the agitator 40B.

In this regard, when the agitator 40B shown in FIG. 13(A) is used as a first agitator 40, it is necessary to use one having a blade skewed in the direction opposite to the former blade as a second agitator 42.

Similarly, when the agitator 40C shown in FIG. 13(B) is used as a first agitator 40, it is necessary to use one having blades skewed in the direction opposite to the former blades as a second agitator 42.

Figure 14:
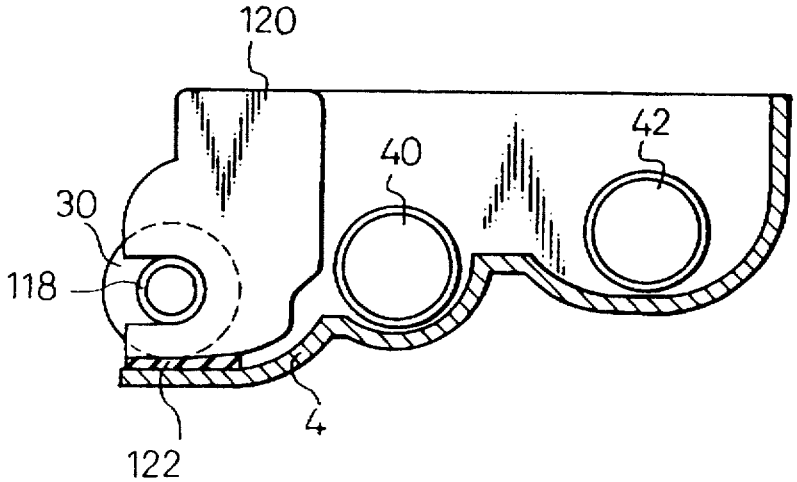
FIG. 14 is a sectional view of a support structure for a developer roller.

A support structure for the developer roller 30 will be explained with reference to FIG. 14. The developer roller 30 is rotatably mounted to a bracket 120 via a bearing 118.

The bracket 120 operates as a reinforcement member for keeping the strength of the development device and also carries parts, beside the developer roller 30, which require a high mounting accuracy such as the doctor blade 36. This bracket 120 is attached to the housing 4e while an anti-vibration member 122 made of elastic rubber is interposed between the housing 4 and the bracket 120.

According to this embodiment, since the anti-vibration member 122 is interposed between the housing 4 and the bracket 120, the vibration of the housing 4 is prevented from being transmitted to the bracket 120, whereby the developer roller 30 is free from the vibration. Accordingly, it is possible to always maintain a constant gap between the developer roller 30 and the photosensitive drum 20.

In a development device wherein no bracket is used for mounting the developer roller 30, an anti-vibration member may be inserted between a shaft of the developer roller and the housing or between a bearing holding the shaft of the developer roller and the housing. Thereby, it is possible to effectively prevent the vibration of the housing from being transmitted to the developer roller.

Figure 15:
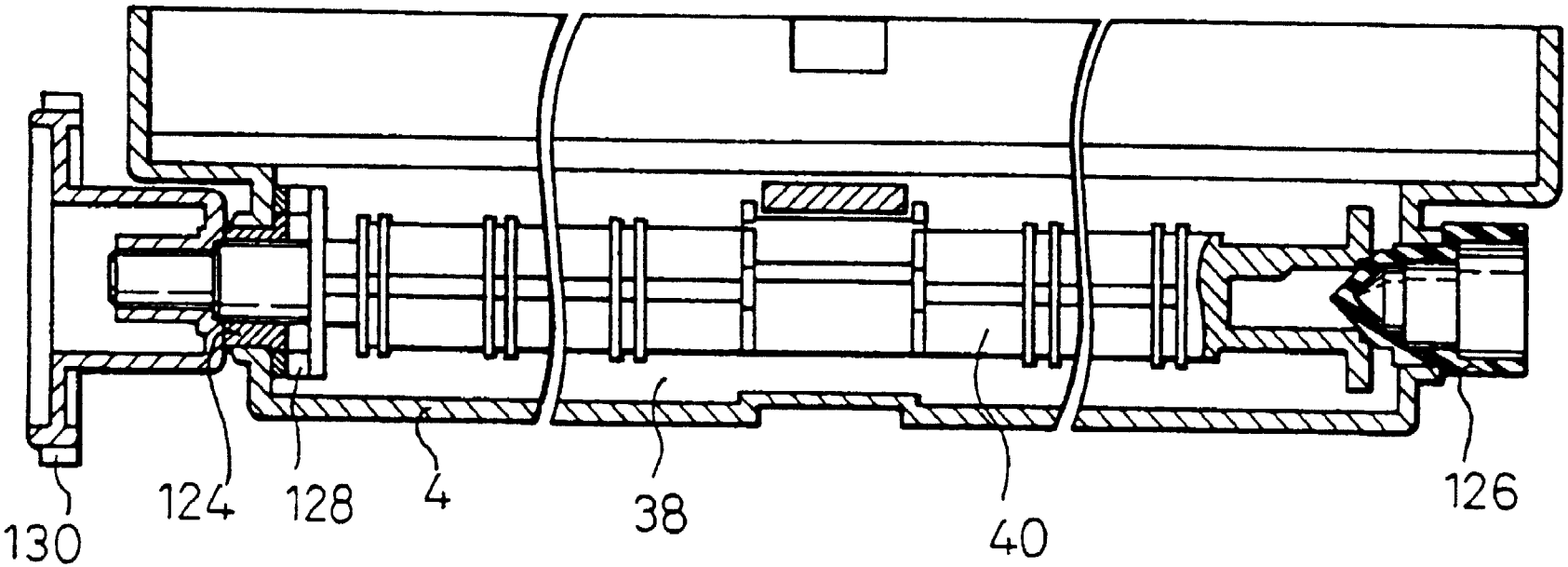
FIG. 15 is a sectional view of a support structure for an agitator.

A support structure for the agitator will be described with reference to FIG. 15. A gear 130 transmits a rotational drive to an agitator 40. One end of the agitator 40 is held by a sleeve bearing 124 and the other end is held by a pivot bearing 126.

A sponge seal 128 is provided for preventing the toner in the toner chamber 38 from leaking outside. The pivot bearing 126 is made of resin and fixed to the housing 4. Accordingly, the toner never leaks outside the pivot bearing 126.

Since the pivot bearing 126 is adapted for holding one end of the agitator 40 in such a manner, it is possible to prevent a rotational torque of the agitator from increasing, which is caused by toner entering into the sleeve bearing, as usually occurs in the prior art. Thereby, it is possible to prevent the carrier chamber from twisting and thus to reduce the unevenness in the printing density or the foggy printing caused by the deformation of the carrier chamber.

Favorable configurations of the partitioning member, which will be explained with reference to FIGS. 16 through 21, are capable of uniformly mixing the carrier and the toner within the carrier chamber so that no unevenness in the toner density generates. The carrier chamber (development chamber) 34 is defined between the developer roller 30 and the partitioning member 32.

Figure 16A:
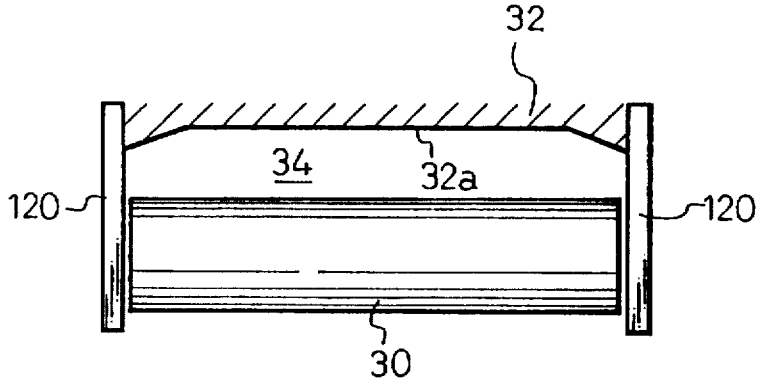
FIGS. 16(A) and 16(B) are illustrations of shapes of partitioning members.

In an embodiment shown in FIG. 16(A), a wall surface 32*a* of the partitioning member 32 is roughened through a surface treatment. The surface treatment can includes planing/polishing, sand blasting or the like. By such a roughening treatment of the wall surface 32*a*, the toner is liable to be uniformly mixed with the carrier in the carrier chamber 34.

Figure 16B:
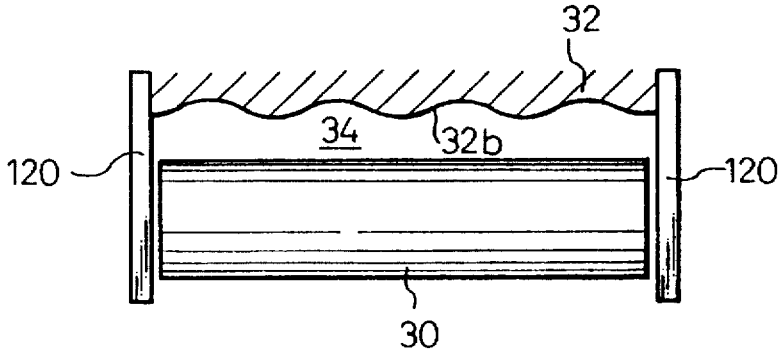
Figure 17A:
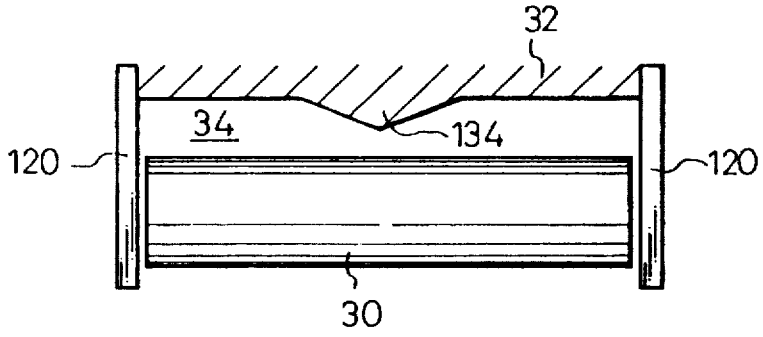
Figure 17B:
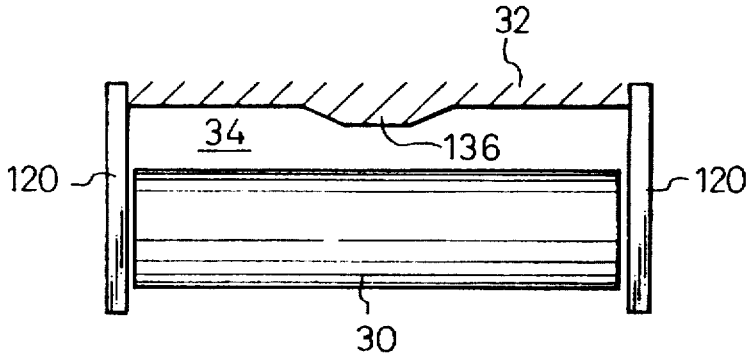
Figure 18A:
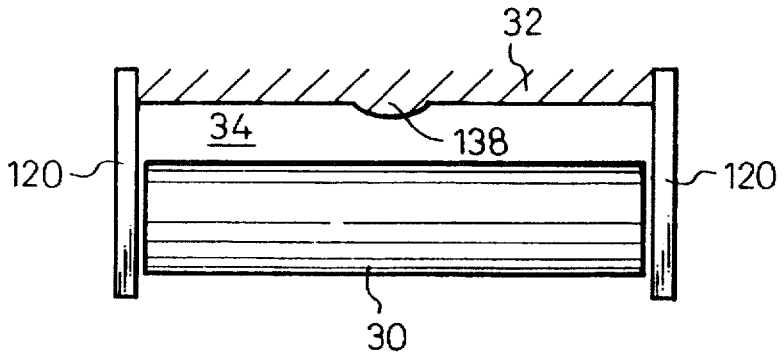
Figure 18B:
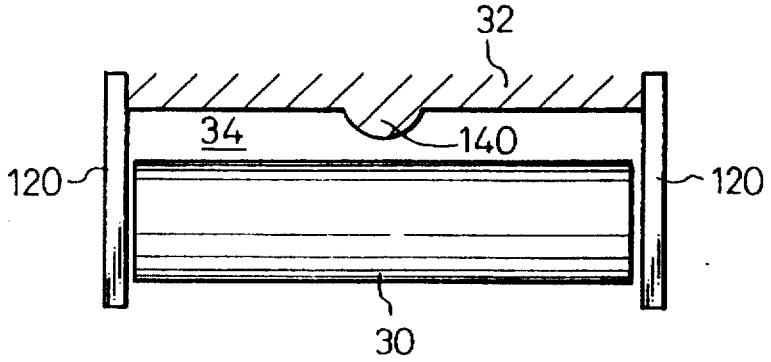

In an embodiment shown in FIG. 16(B), a wall surface 32*b* of the partitioning member 32 is undulated to thoroughly agitate the developing agent. Most favorably, the surface 32*b* of the partitioning member 32 has a wavy shape whereby the developing agent is easily moved in the axial direction of the developer roller 30.

FIGS. 17(A) through FIG. 18(B) show other preferable configurations of the partitioning member 32, wherein the partitioning member 32 has, at a widthwise central zone of the cross-section thereof, a triangular bulge 134, a trapezoidal bulge 136, an semi-oval bulge 138 and a semicircular bulge 140, respectively.

By providing various configuration bulges in a widthwise central zone of the partitioning member 32, an axial flow of the toner is suppressed to correct the irregular distribution of the developing agent. If the irregular distribution of the developing agent is corrected, it is possible to make the toner density even, resulting in a good image quality.

Figure 19:
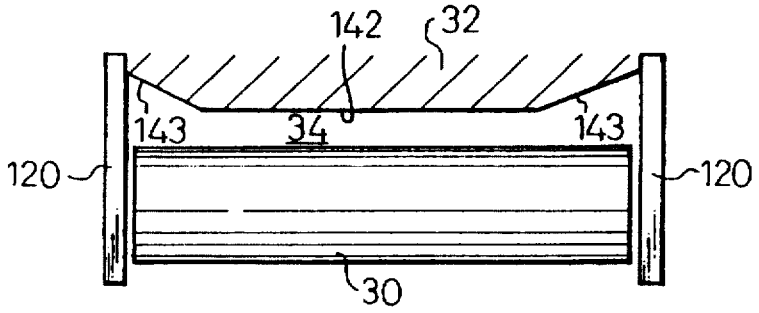
Figure 20A:
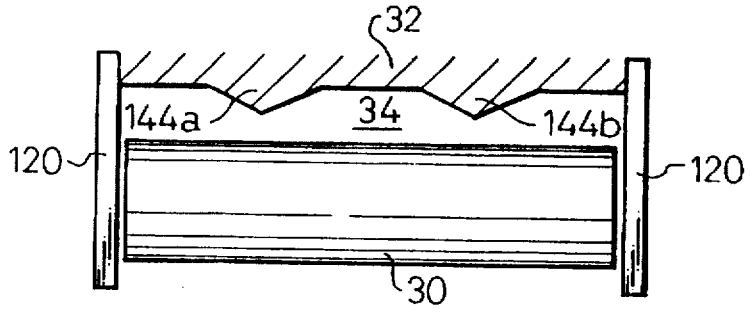
Figure 20B:
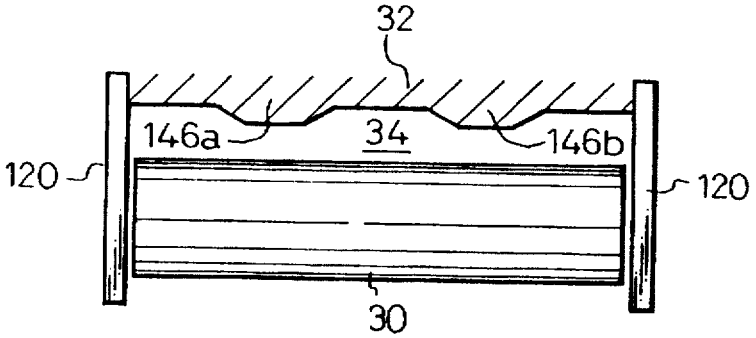
Figure 21A:
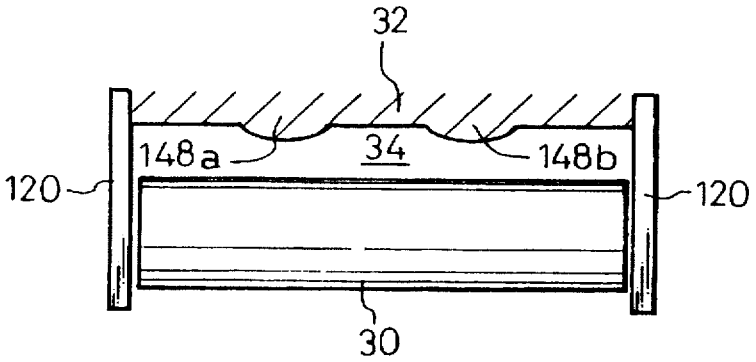
Figure 21B:
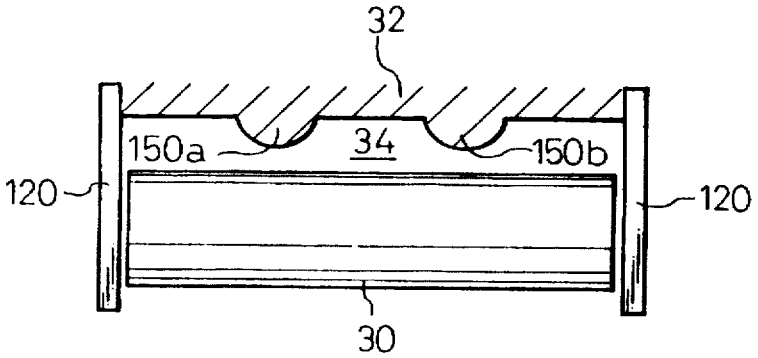

FIG. 19 shows a further configuration of the partitioning member. The partitioning member 32 is shaped so that a widthwise central zone 142 of a wall surface is generally parallel to the developer roller 30 and both end zones 143 thereof are gradually tapered away from the developer roller 30.

Thereby, it is possible to increase a capacity of the carrier chamber at the end zones wherein the toner density is liable to be high due to the axial displacement of the developing agent, and thus to equalize the toner density as a whole. By equalizing the toner density, foggy printing and irregular density printing is avoided, resulting in a favorable image quality.

FIGS. 20(A) through 21(B) show further more configurations of the partitioning member. That is, in these embodiments, a plurality of bulges (two in the illustrations) are provided on a wall surface of the partitioning member 32 opposite to the developer roller 30.

The cross-sectional configuration of the bulges may be selected from a group consisting of triangles 144*a*, 144*b*, trapezoids 146*a*, 146*b*, semi-ovals 148*a*, 148*b* and semicircles 150*a*, 150*b*.

By providing two bulges of various configuration on the wall surface of the partitioning member 32 opposite to the developer roller 30, it is possible to suppress the developing agent from flowing in the axial direction from the both end zones to the central zone, by the bulges, so that the toner density is equalized in the axial direction over the developer roller 30.

Figure 22A:
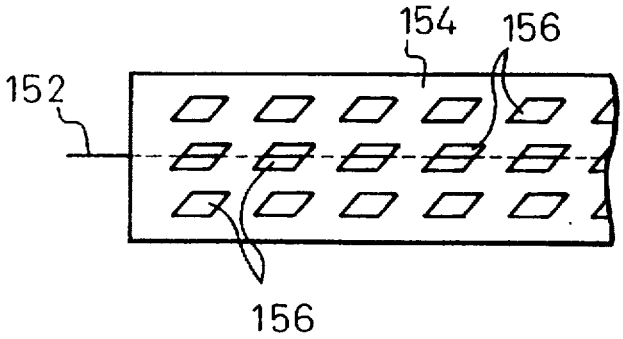
FIGS. 22(A) and 22(B) are illustrations of shapes of grids of a scorotron charger.

In FIGS. 22(A) and (B), grid configurations of a scorotron charger according to the present invention are illustrated.

In the conventional scorotron charger, no aperture is provided in a central area of a grid electrode, for allowing a discharging wire to pass, but a grid electrode shields the discharging wire from the photosensitive drum. Thereby, irregular charging may occur on the photosensitive drum, which particularly causes the deterioration of the reproducibility of halftones.

Figure 22B:
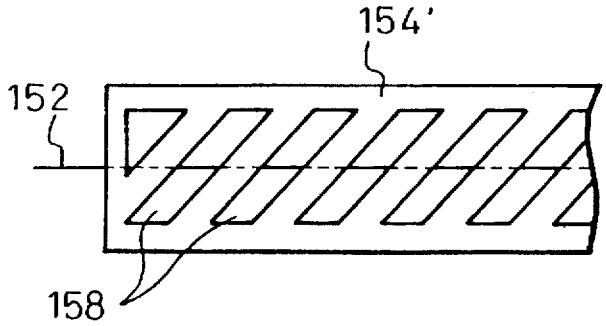

Accordingly, in these embodiments of the present invention, a plurality of parallelogram-shaped apertures 156 are provided in a central area of a grid 154 at a position where a discharging wire 152 extends, as shown in FIG. 22(A). Or, as shown in FIG. 22(B), a plurality of larger parallelogram-shaped apertures 158 may be provided on a grid 154'.

As stated above, in the scorotron chargers of these embodiments, since the grids 154, 154' have the apertures 156, 158, respectively, in the central areas thereof where the discharging wires 152 extend, it is possible to uniformly charge the surface of the photosensitive drum and thus to improve the reproducibility of halftones.

Figure 23:
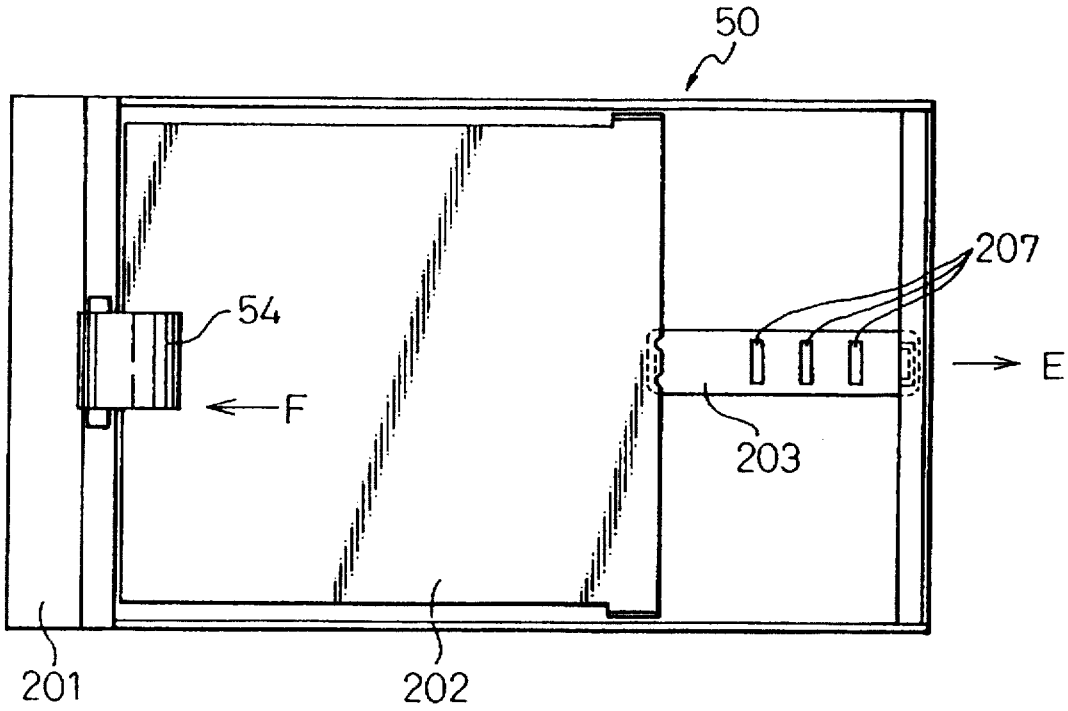
FIG. 23 is a plan view of a paper cassette.

FIG. 23 shows the paper cassette 50 for an automatic paper supply. As shown in FIG. 3, the cassette 50 accommodating a number of paper sheets 52 therein in a stacked state, is mounted to a cassette receiving portion on the bottom of the printer and is detachable in the arrowed direction E. When the paper cassette 50 is fully mounted to the printer, a front end of the paper as seen in the paper supply direction F is positioned closer to a pick roller 54 on the printer body.

The paper cassette 50 of this embodiment includes a cassette body 201, a pressure plate 202 mounted to the cassette body to be rockable on a pivot 205, and an end guide 204 operatively coupled to the pressure plate 202 via a resilient member 203 such as a MYLAR sheet.

Figure 24A:
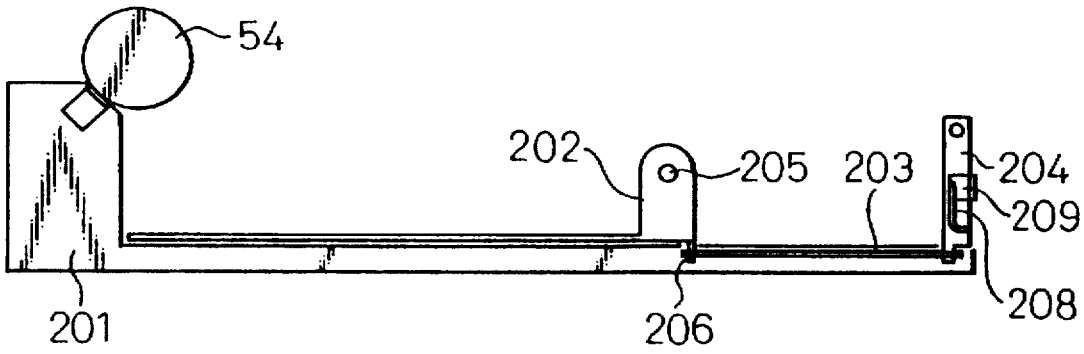
FIGS. 24(A) and 24(B) are illustrations for explaining the operation of the paper cassette; (A) wherein a paper amount is large, and (B) wherein a paper amount is low.
Figure 24B:
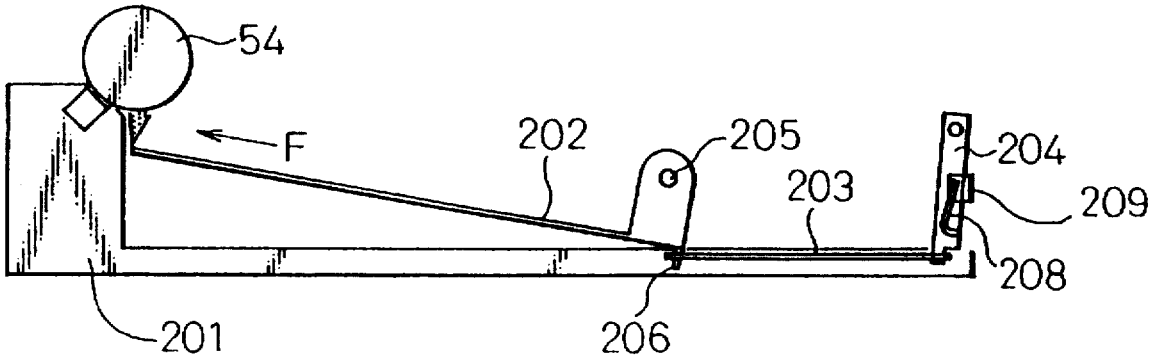

The pressure plate 202 holds a stack of paper sheets at a front end thereof from the under side, which is maintained generally horizontal when a large number of paper sheets is present therein, as shown in FIG. 24(A), but rotates on the pivot 205 when a small number of paper sheets is present, as shown in FIG. 24(B), to urge the front end of the paper sheets into contact with the pick roller 54. Thereby, irrespective of the amount of paper left in the cassette, the uppermost paper sheet in the cassette 50 is pushed up so that the front end thereof is always brought into contact with the pick roller 54. The end guide 204 is rockably coupled to the cassette body 201 at the upper end thereof, while the lower end of the end guide is operatively coupled to the pressure plate 202 via the MYLAR sheet 203.

When a large number of paper sheets is present, the pressure plate 202 is generally horizontal as shown in FIG. 24(A) to push up the front end of the uppermost paper sheet in the stack to be in contact with the pick roller 54. As the number of paper sheets decreases, the pressure plate 202 rotates on the pivot 205 to raise the paper sheets so that the front end of the uppermost paper sheet is brought into contact with the pick roller 54, as shown in FIG. 24(B). At that time, the MYLAR sheet 203 coupled to the pressure plate 202 at a position 206 lower than the pivot 205 is made to rotate forward (in the direction F) while being pulled by the pressure plate 202, whereby the lower end of the end guide 204 moves forward. Thus, the end guide 204 pushes the rear end of the paper sheet forward to cause the front end of the paper to be assuredly in contact with the pick roller 54.

As stated above, according to this embodiment, since the rear end of the paper sheet is pushed by the end guide 204 when the number of paper sheets decreases, the front end of the paper sheet is assuredly brought into a position in contact with the pick roller 54, whereby erroneous picking is avoided.

In this regard, the MYLAR sheet 203 in this embodiment is provided in a central zone of a rear area of the paper cassette, and has a plurality of apertures 207 arranged in the travelling direction of the paper. A paper size is detected by an optical sensor (not shown) through these apertures 207 and input to a controller (not shown) of the printer. Since the end guide 204 cannot be restored to the original position solely by an elastic force of the MYLAR sheet 203 after the pressure plate 202 occupies a lower position as shown in FIG. 24(A), a spring 208 made of resin is provided in the end guide 204 for assuredly restoring the end guide 204 to the original position and absorbing slack in the MYLAR sheet 203. In this regard, a plastic spring 208 is mounted in an opening 209 in the cassette body 201.

Figure 25A:
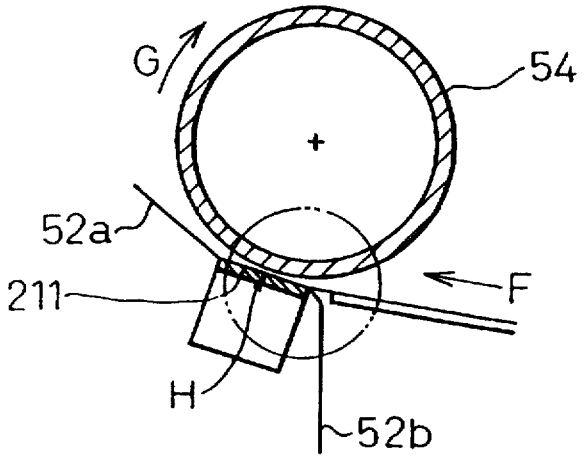
Fig.25(A) PRIOR ART
FIGS. 25(A), 25(B) and 25(C) are illustrations of a paper supplying mechanism of a pick roller; 25(A) and 25(B) being prior arts, and 25(C) being the present invention.
Figure 25B:
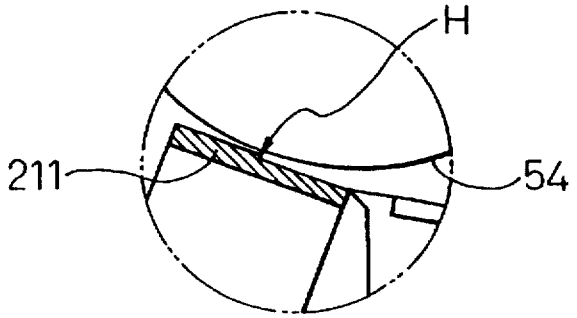
Fig.25(B) PRIOR ART
Figure 25C:
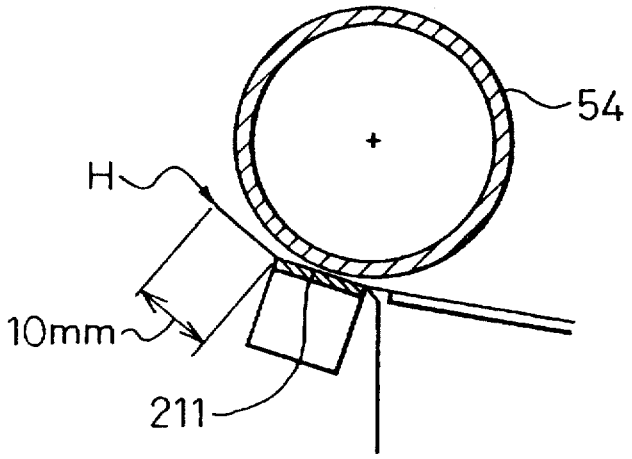

FIGS. 25(A) through (C) illustrate a paper supplying mechanism of the pick roller 54. The pick roller 54 is brought into contact with the front end of the uppermost paper in the paper cassette 50 and also with a separation pad 211 disposed at a forward position as seen in the paper supply direction F. When the pick roller 54 rotates in the arrowed direction G, the uppermost paper 52*a* in the paper cassette 50 is moved forward by the pick roller 54, but a second paper 52*b* is prevented from moving forward by the frictional contact with the separation pad 211 whereby a front end H of the paper 52*b* is kept stationary while being nipped between the pick roller 54 and the separation pad 211. If there is no command for starting the printing operation for the second paper 52*b* after the printing operation for the first paper 52*a* has been finished, the front end H of the paper is left for a long time while being nipped between the pick roller 54 and the separation pad 211, as shown in FIGS. 25(A) and (B), which results in the deformation of rubber covering the surface of the pick roller 54 and/or the separation pad 211 and the deterioration of durability and picking function thereof.

To solve such drawbacks, according to this embodiment, the pick roller 54 is made to rotate, by a predetermined amount, an instant after the printing operation for the first paper has been finished or directly after the first paper has left the pick roller 54, so that the front end H of the next paper is located at a waiting position about 10 mm forward of the separation pad 211, as shown in FIG. 25(C), until the next printing command is issued. Since no front end H of the paper is present in a nip between the pick roller 54 and the separation pad 211 although a paper sheet is present therein, there is no risk of deformation of rubber on the surface of the pick roller 54 and/or the separation pad 211 even though such a state continues for a long time.

Figure 26:
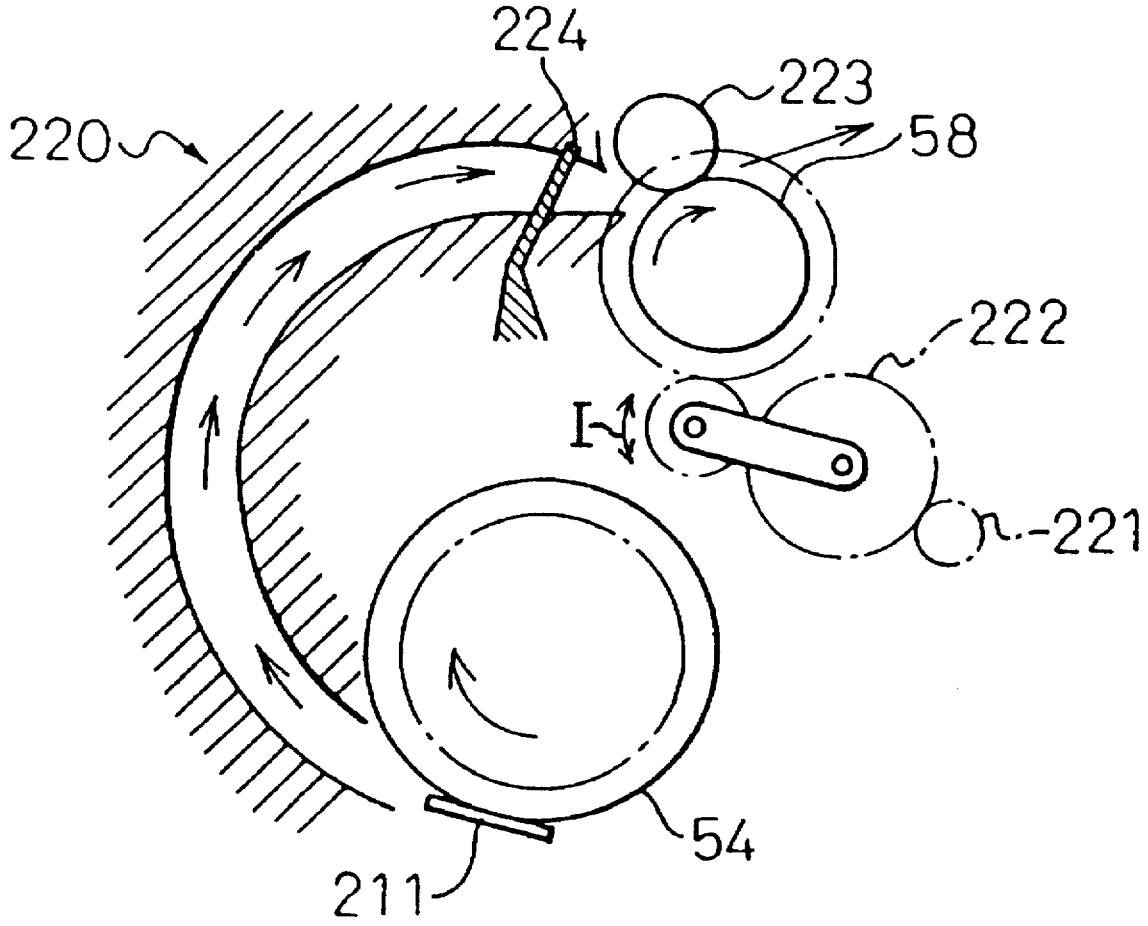
FIG. 26 is a diagrammatic view of a first embodiment of a paper conveying mechanism.

FIG. 26 shows a first embodiment of a paper supply mechanism by means of the pick roller 54 and the register roller 58. In the automatic paper supply from the paper cassette 50, as stated before, a paper sheet in the paper cassette 50 is delivered by the pick roller 54 and conveyed into a gap between the photosensitive drum 46 and the transfer charger 60 by the register roller 58 after being diverted about 180°. Accordingly, as shown in FIG. 26, a conveying guide 220 is provided between the pick roller 54 and the register roller 58, for forming a U-shaped path.

In the paper supplying mechanism according to this embodiment, the pick roller 54 and the register roller 58 are driven by a common motor. That is, the torque of the motor is selectively transmitted to either the pick roller 54 or the register roller 58 by displacing a planetary gear train 222 meshed with a motor pinion 221 in the arrowed directions I. FIG. 26 also shows a metallic roller 223, a paper supply sensor 224 and gears indicated by a chain line circle.

Figure 27:
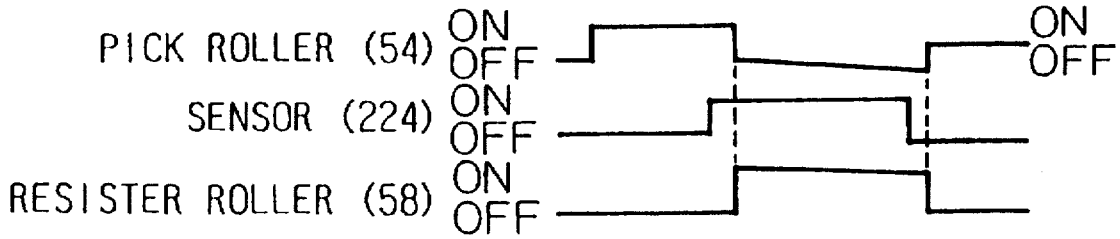
FIG. 27 is a time chart of the operation of the paper conveying mechanism shown in FIG. 26.

This paper supplying mechanism operates in accordance with a time chart shown in FIG. 27. First, the pick roller 54 is in the operative state and the paper is conveyed thereby. When the front end of the paper reaches the paper supply sensor 224 and a predetermined period has lapsed, the sensor 224 is made ON whereby the torque transmission is switched from the pick roller 54 to the register roller 58, which sensor is provided in front of the register roller 58 at a proper position in the conveying guide 220. Since the front end of the paper has reached the register roller 58 at that time, the paper is conveyed by the register roller 58 thereafter until the printing operation is finished. When the rear end of the paper reaches the sensor 224 and a predetermined period has lapsed, the sensor is made OFF whereby the torque transmission is switched from the register roller 58 to the pick roller 54. The rear end of the paper leaves the register roller 58 at that time.

Figure 28:
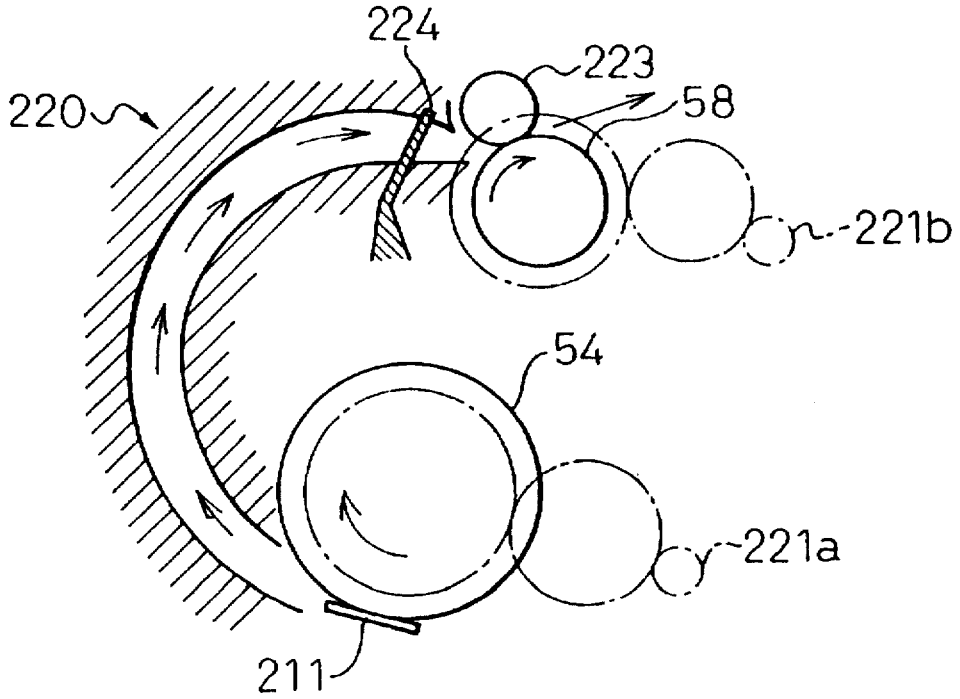
FIG. 28 is a diagrammatic view of a second embodiment of a paper conveying mechanism.

FIG. 28 illustrates a second embodiment of the paper supplying mechanism using the pick roller 54 and the register roller 58. In this embodiment, the pick roller 54 and the register roller 58 are individually driven by separate motors or by a common motor via two drive systems, each having a magnetic clutch. For example, as schematically shown in FIG. 28, motor pinions 221*a*, 221*b* are provided, while being coupled to the pick roller 54 and the register roller 58, respectively, so that both the rollers are independently driven.

Figure 29:
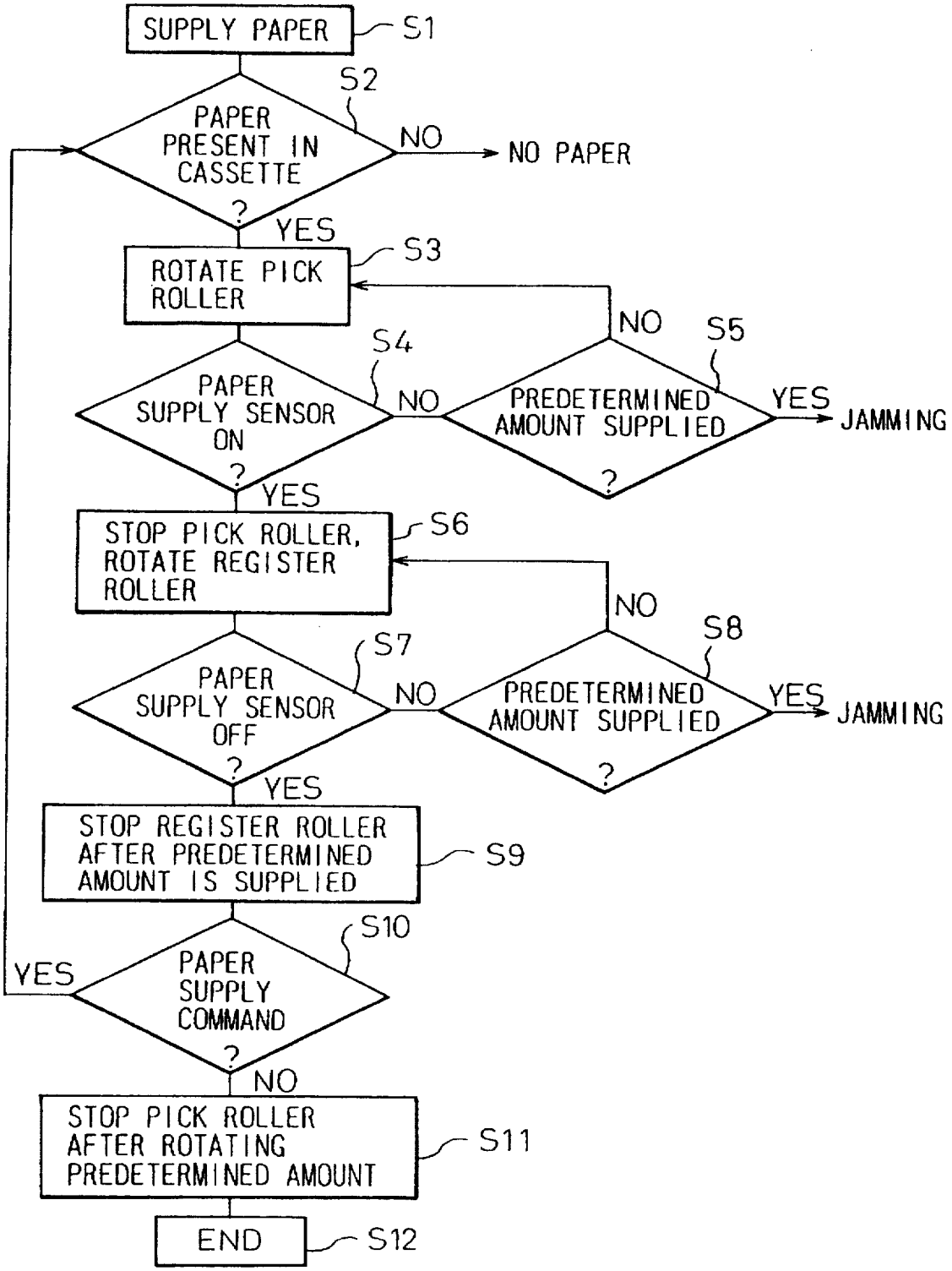
FIG. 29 is a flow chart of one operation of the paper conveying mechanism shown in FIG. 26.

FIG. 29 is a flow chart for the operation of the paper supplying mechanism according to the first embodiment of a drive-switching type shown in FIG. 26. When the paper supply command is issued at step S1, a sensor (not shown) in a paper supply part detects at step S2 whether or not the paper sheets are present in the paper cassette 50, and if the answer is negative, issues an alarm. On the contrary, if the answer is affirmative, the pick roller 54 is made to rotate at step S3. The pick roller 54 continues to rotate to convey the paper until at step S4 the paper supply sensor is made ON. When the paper supply sensor does not become ON even after a predetermined length of paper has been fed at step S5, an alarm is issued, indicating that a paper jam may have occurred. If the paper supply sensor is made ON and a predetermined time has lapsed, the drive is switched from the pick roller 54 to the register roller 58 at step S6, to supply the paper by the register roller 58 until the paper supply sensor 224 becomes OFF at step S7. When the paper supply sensor 224 does not become ON even after a predetermined length of paper has been fed at step S7, an alarm is issued, indicating that a paper jam may have occurred. When a predetermined time has lapsed after the paper supply sensor 224 became OFF, the register roller 58 is made to stop at step S9. If the next paper supply command at step S10 is issued, the above steps are repeated, and contrarily, if not, at step S11 the drive is switched from the register roller 58 to the pick roller 54, whereby the pick roller 54 is made to rotate by a predetermined amount to locate the front end of the paper at a position about 10 mm forward of the nip between the pick roller 54 and the separation pad 211, and is made to stop there at step S12. Thus the process is finished.

Figure 30:
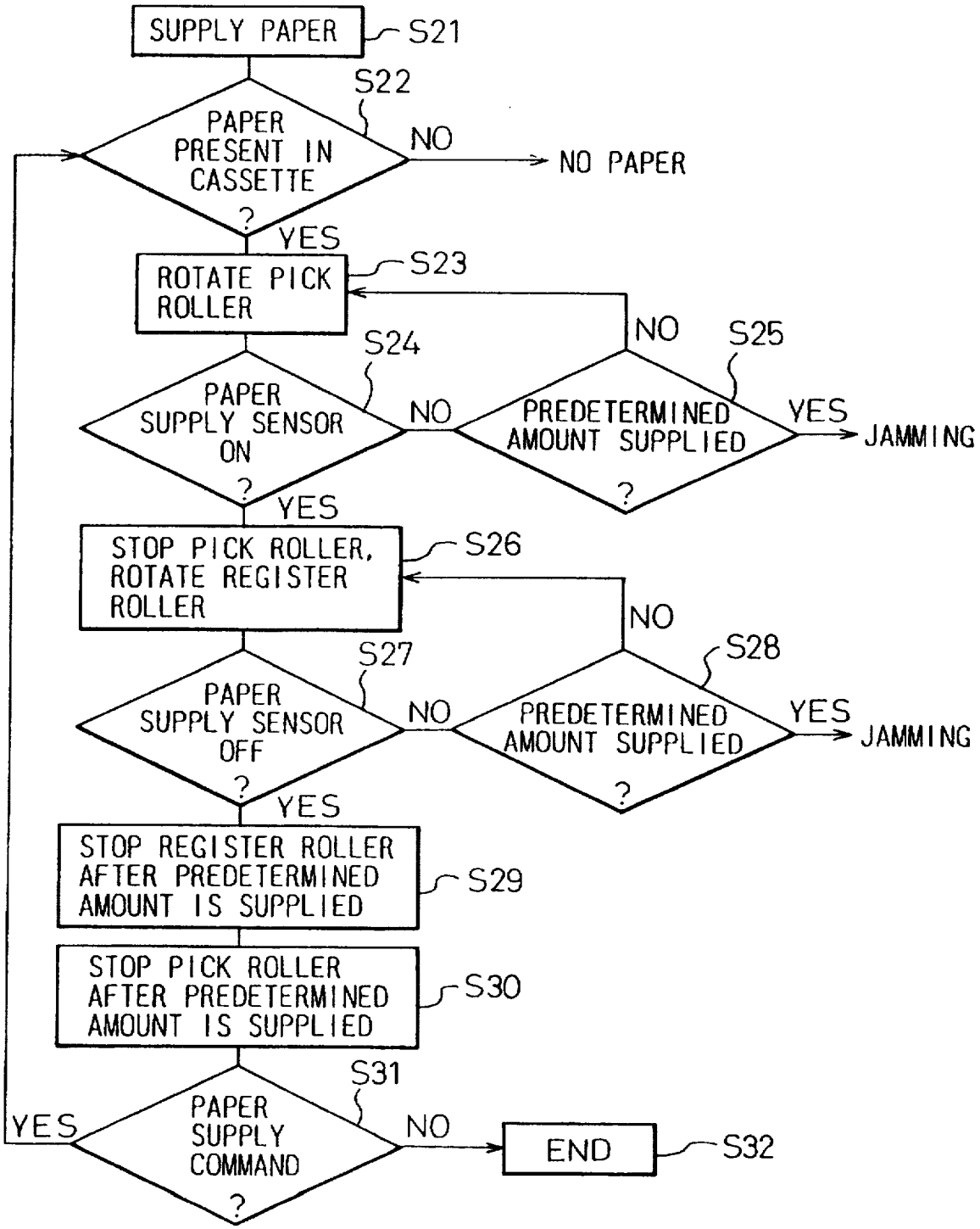
FIG. 30 is a flow chart of another operation of the paper conveying mechanism shown in FIG. 26.

FIG. 30 is another flow chart for the operation of the paper supplying mechanism according to the first embodiment described before. The explanation will be made solely on the difference from the treatment shown in a FIG. 29 and therefore steps S21 through S28 will not be explained. When a predetermined time has lapsed after the paper supply sensor 224 becomes OFF at step S27, the drive is immediately switched from the register roller 58 to the pick roller 54. The register roller 58 is made to stop at step S29, and the pick roller 54 is made to rotate by a predetermined amount to locate the front end of the paper at a position about 10 mm forward of the nip between the pick roller 54 and the separation pad 211 at step S30. If the next paper supply command is issued at step 31, these steps are repeated, while, if not, the process is finished at step 32.

Figure 31:
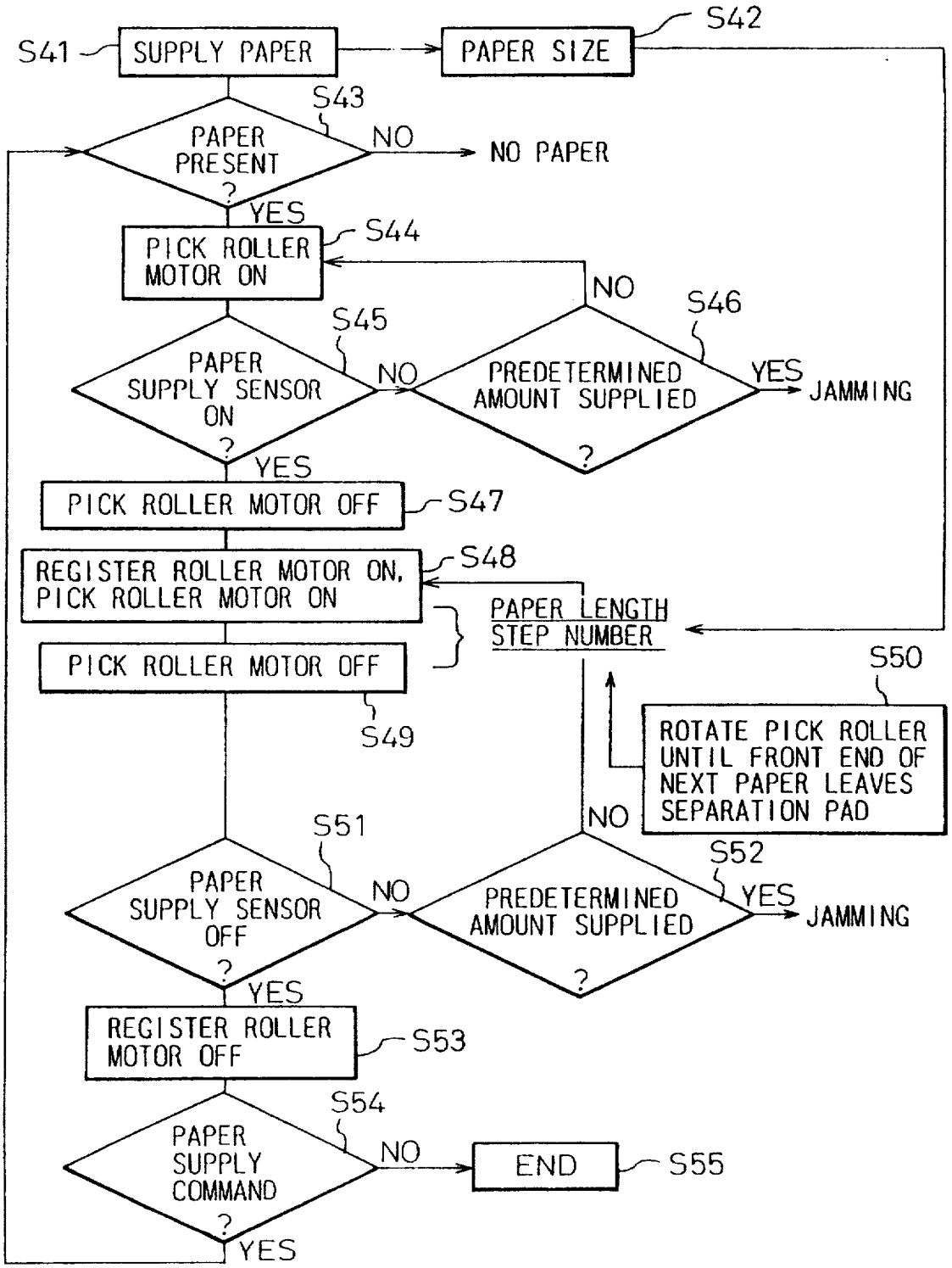
FIG. 31 is a flow chart of the operation of the paper conveying mechanism shown in FIG. 28.
Figure 32:
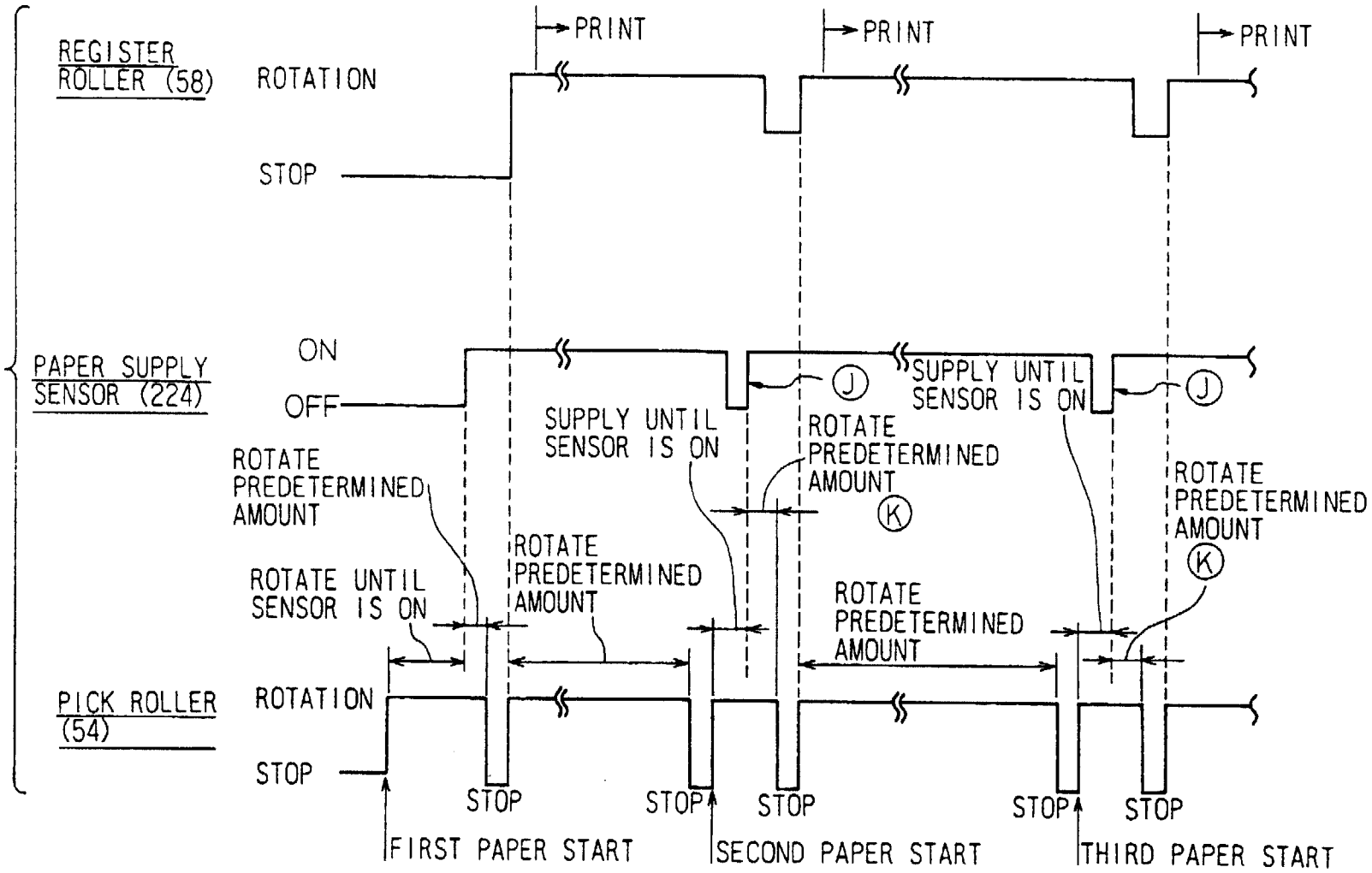
FIG. 32 is a time chart of the operation of the paper conveying mechanism shown in FIG. 28.

FIG. 31 is a flow chart for the operation of the paper supplying mechanism according to the second embodiment shown in FIG. 28, and FIG. 32 is a time chart thereof. When the paper supply command is issued at step S41, a sensor (not shown) in a paper supply part detects whether or not the papers are present in the paper cassette 50 at step S43, and if the answer is negative, issues an alarm. On the contrary, if the answer is affirmative at step S44, the pick roller 54 is made to rotate (the pick roller motor is made ON). The pick roller 54 continues to rotate to convey the paper until at step S45 the paper supply sensor 224 is made ON. When the paper supply sensor does not become ON even after a predetermined length of paper has been fed at step S46, an alarm is issued, indicating that a paper jam may have occurred. If the paper supply sensor is made ON at step S45, the pick roller motor is made OFF at step S47 to stop the pick roller after a predetermined time has lapsed. After a predetermined time has lapsed, the register roller motor is made ON (to rotate the register roller) and the pick roller motor is again made ON at step S48. Accordingly, the paper is conveyed by both the register roller 58 and the pick roller 54 to be printed. The pick roller 54 is made to stop at step S49 after rotating by a predetermined amount based upon the paper size determined at step S42. The predetermined amount referred hereto is a rotational amount necessary for conveying the front end of the paper to a position away from the separation pad 211 as described with reference to FIG. 25(A) see also step S50. When the paper supply sensor 224 is made OFF at step S51; i.e., when the rear end of the preceding paper sheet leaves the paper supply sensor 224 and a predetermined time has lapsed at step S52, the register roller 58 is made to stop at step S53. If the next paper supply command is issued at step S54, the above steps are repeated, and contrarily, if not, the process is finished at step S55.

According to the time chart shown in FIG. 32, the pick roller 54 is made to rotate to deliver a first paper. The pick roller is made to stop after a predetermined amount of rotation when the paper supply sensor becomes ON. After a predetermined time has lapsed, both the register roller 58 and the pick roller 54 are made to rotate whereby the printing operation is made on the paper sheet. At that time, the paper sheet is conveyed by both the register roller 58 and the pick roller 54. The pick roller 54 is made to stop after rotating a predetermined amount. At that instant, the first paper already leaves the pick roller 54. After a predetermined rest time, the pick roller 54 is made to rotate again to convey a second paper. The pick roller 54 is made to stop when further rotating by a predetermined amount (section K) after the paper supply sensor becomes OFF by the passage of the rear end of the first paper and becomes ON by the passage of the front end of the second paper (section J). After a predetermined time has lapsed, the register roller 58 and the pick roller 54 are made to rotate to conduct a printing operation for the second paper. The paper supply is carried out by repeating the above steps.

As described above, by driving the pick roller 54 and the register roller 58 independently from each other by separate motors or via magnetic clutches, it is possible to drive the pick roller until the paper escapes from the pick roller, and thus to eliminate the increase in load due to the drag of the paper between the pick roller and the register roller and minimize noise caused by the drag or the frictional contact with the conveying guide. That is, according to the above structure, since the load on the register roller motor can be reduced, it is possible to use an inexpensive motor of a lower quality. Further, since the shock can be mitigated when the paper is extracted from the pick roller, erroneous transfers are avoidable.

Figure 33A:
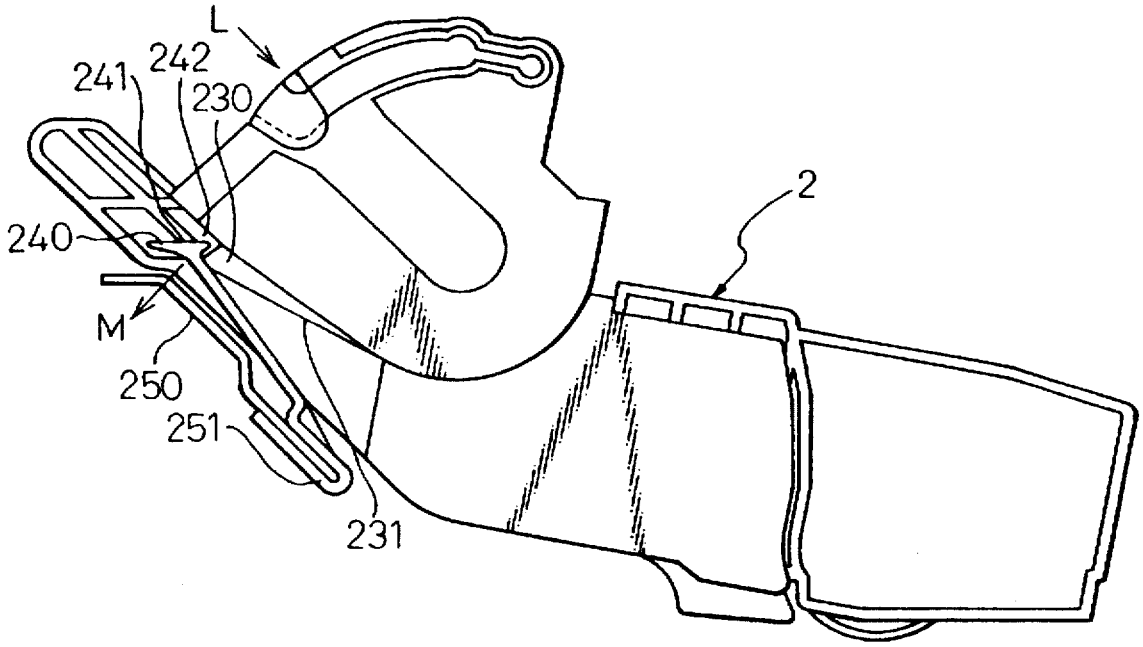
FIGS. 33(A), 33(B) and 33(C) are illustrations of a locking mechanism for the process unit.

FIGS. 33(A), (B) and (C) show a locking mechanism for a process unit 2. As already explained with reference to FIGS. 1 and 2, the process unit 2 of the laser printer in the present invention is detachably mounted to a printer body and, in turn, the toner cartridge 44 is detachably mounted to the process unit 2.

FIG. 33(A) shows a state in which the process unit 2 having no toner cartridge 44 is mounted to the printer. The process unit is inserted into the printer body along a guide part not shown in the arrowed direction L. During the insertion, a slope 231 of a locking part 230 of the process unit 2 is first brought into contact with a slope 241 of a locking member 240 of the printer body. Since the locking member 240 has a configuration to exhibit elasticity, it is elastically deformed downward (in the arrowed direction M) to allow the slope 231 of the locking part 230 of the process unit 2 to pass over the slope 241 of the locking member 240. Upon passing over, a hook 242 of the locking member 240 engages with the locking part 230 to secure the process unit 2 at a position in a non-detachable manner. As shown in FIG. 33(C), the configurations of these engaging parts are preferably such that angles θ1 and θ2 relative to the withdrawal direction N (opposite to the arrowed direction L) are both smaller than 90°, which are the inclinations of the hook of the locking part 230 in the process unit and of the hook 242 of the locking member 240 in the printer body, respectively, so that the hooks are more firmly engaged with each other if a force for withdrawing the process unit 2 from the printer operates.

The locking member 240 is positioned at a place by a U-shaped section 251 provided on a frame 250 of the printer and secured there by nipping the frame 250.

Figure 33B:
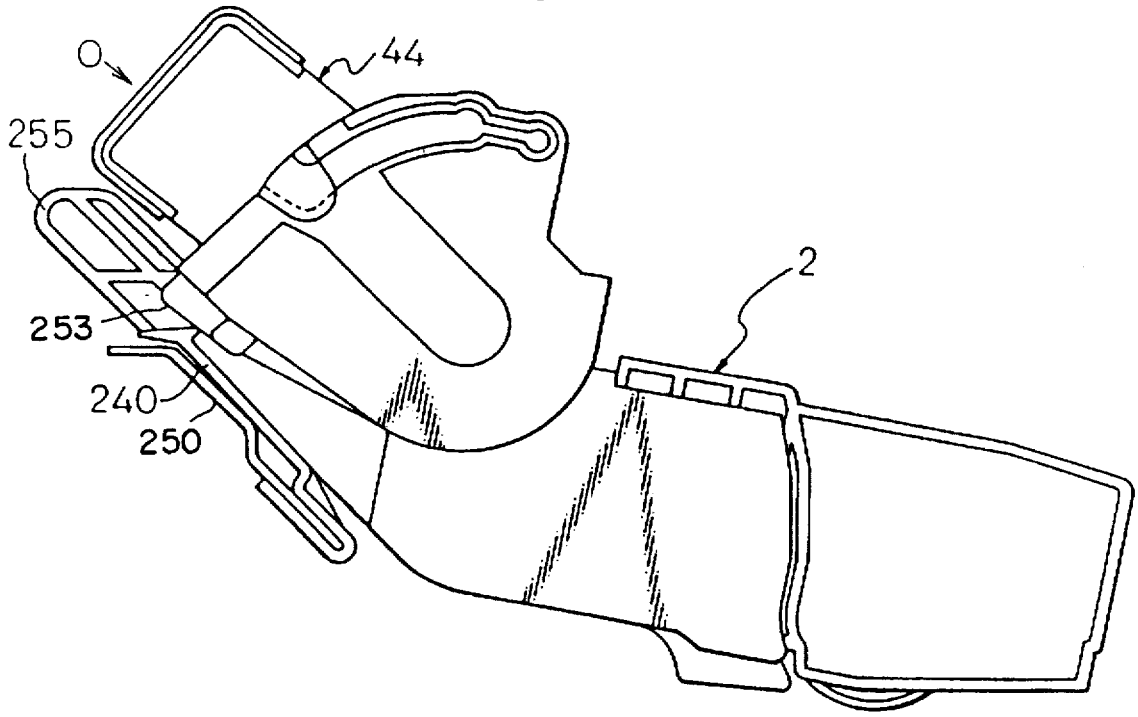
Figure 33C:
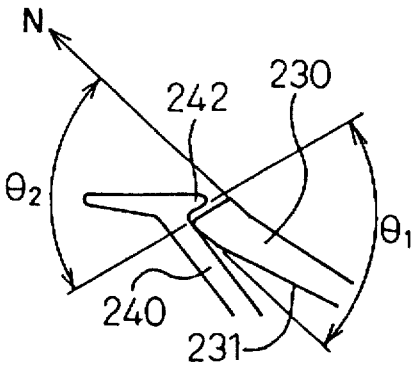

FIG. 33(B) shows a state wherein the toner cartridge 44 is inserted into the process unit 2 in the arrowed direction O. As illustrated, the locking member 240 is pushed down by a lock-releasing projection 253 provided on the toner cartridge 44 opposite to the locking member 240 and is disengaged from the locking part 230 of the process unit 2. Under the circumstances, it is possible to remove the process unit 2 from the printer body by gripping a grip 255 if a trouble such as paper jamming occurs.

A pair of such locking mechanisms may be provided on the left and right sides, respectively, for the purpose of obtaining a more stable operation.

Figure 34A:
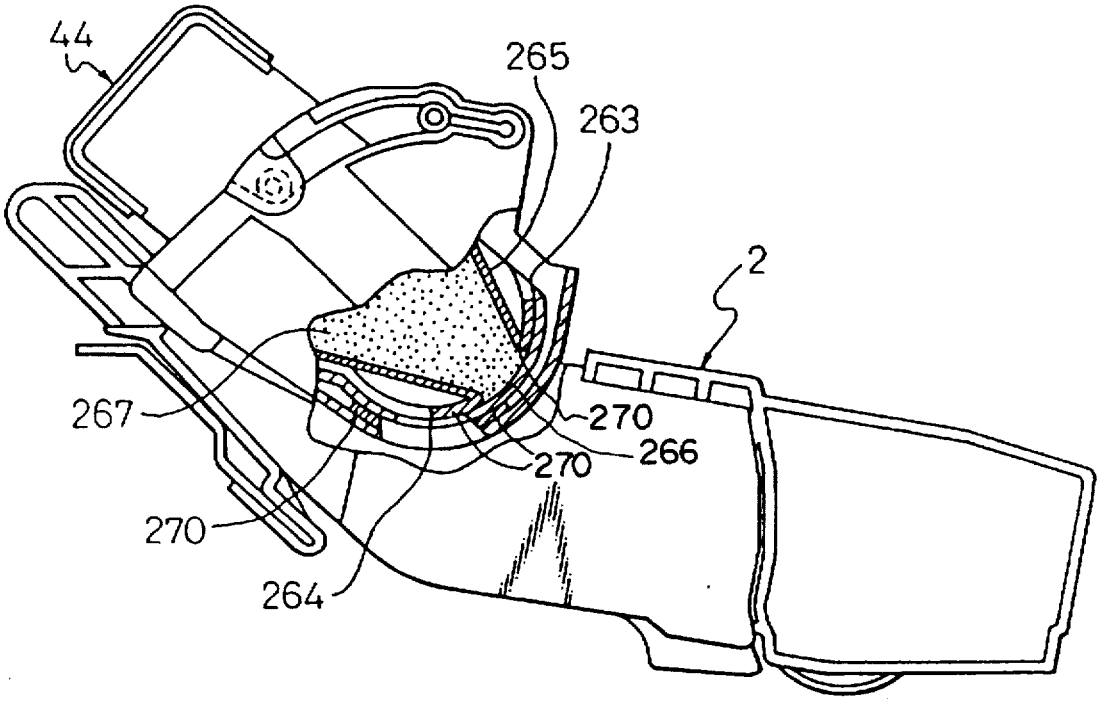
FIGS. 34(A) and 34(B) are illustrations of a mounting mechanism for the toner cartridge.
Figure 34B:
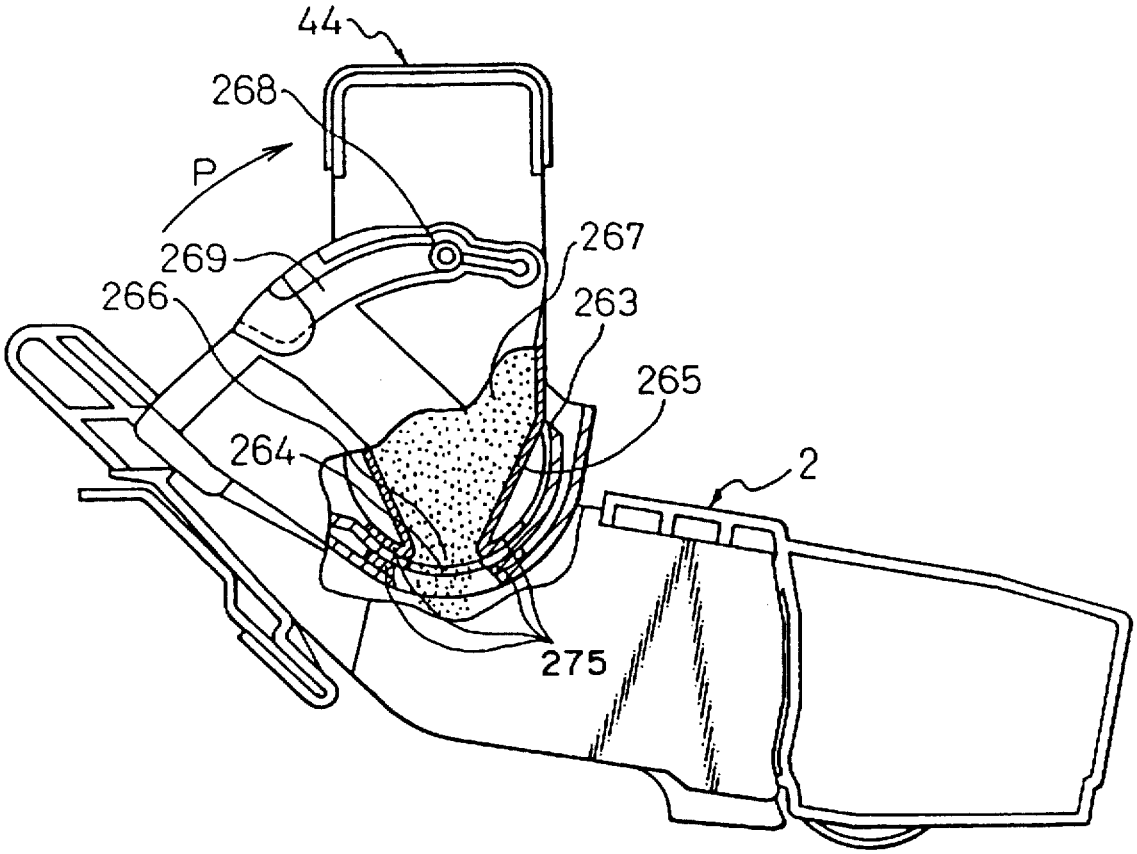

FIGS. 34(A) and (B) illustrate partially sectional views of the toner cartridge 44 mounted to the process unit 2. FIG. 34(A) shows a state immediately after the cartridge 44 has been mounted to the process unit 2, wherein toner 267 does not enter the interior of the process unit 2 because an opening 264 in an outer cover 263 of the toner cartridge 44 is not aligned with an opening 266 in an inner cover 265. FIG. 34(B) shows an operative state of the toner cartridge 44, wherein both the openings 264 and 266 are aligned with each other by the rotation of the inner cover 265 in the arrowed direction P whereby the toner supply to the process unit 2 starts.

Elastic seal members 275 are provided for blocking gaps between the outer cover 263 and the inner cover 265 and between the outer cover 263 and the process unit 2. The toner cartridge 44 is fixed by the engagement of a pin 268 of the inner cover 265 with a slit 269 of the process unit 2.

As stated above, by providing the locking mechanism capable of inhibiting the removal of the process unit 2 from the printer body when no toner cartridge 44 is present therein, it is possible to effectively and inexpensively prevent the contamination of the printer area due to toner leakage from the process unit which might occur when the process unit 2 alone is removed. Accordingly, the contamination of environment and non-printed or printed papers due to toner leakage to exterior and interior of the printer is avoided and results in improved printing quality.

Figure 35A:
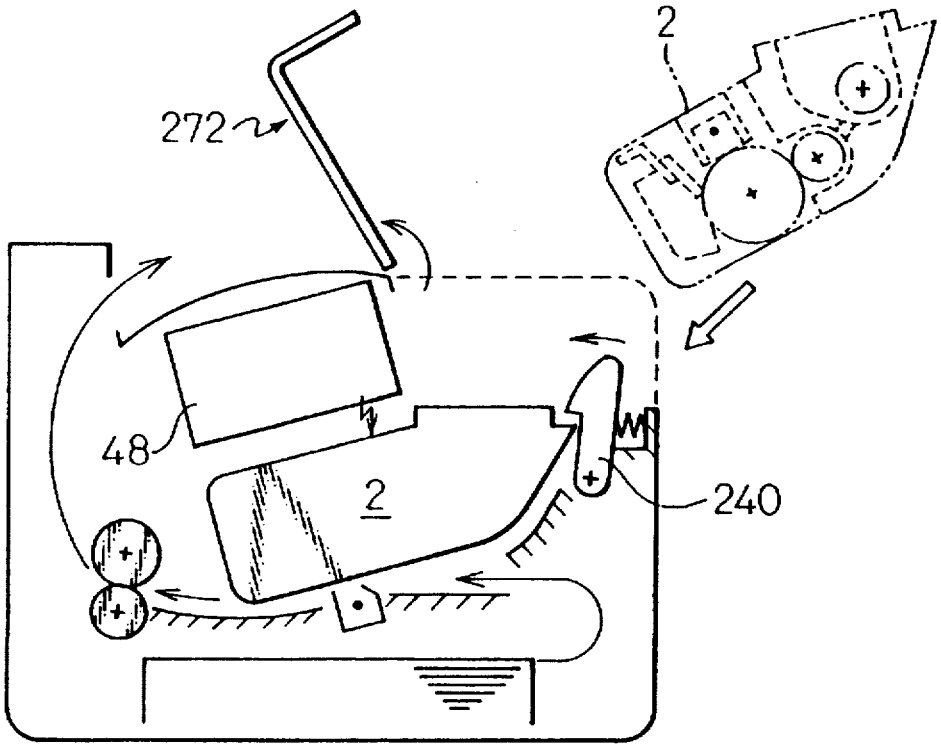
FIGS. 35(A) and 35(B) are illustrations of another locking mechanism for the process unit.
Figure 35B:
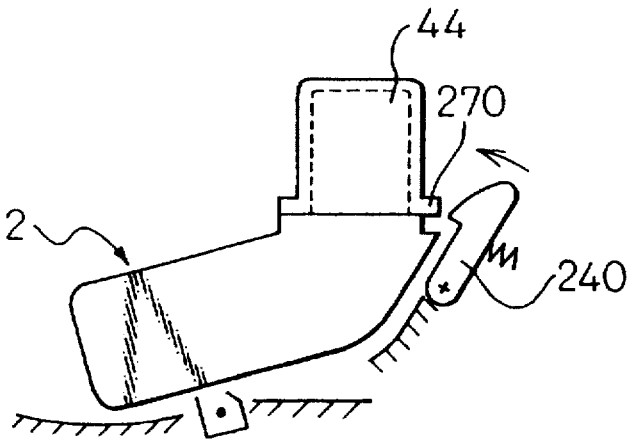

FIGS. 35(A) and (B) show another embodiment of a locking mechanism for the process unit. FIG. 35(A) schematically shows an overall structure of a printer, wherein the process unit 2 is inserted into the printer in the arrowed direction L by opening a cover 272 of the printer. When fully inserted, the process unit 2 is automatically locked by the action of a locking member 240 on the printer body. In FIG.

35(B), when the toner cartridge 44 is mounted to the process cartridge 2, a projecting lock-releasing member 270 on the toner cartridge 44 pushes the locking member 240 against a spring force thereof to release the locking operation. Accordingly, in this embodiment, the process unit 2 is removable from the printer body only when the toner cartridge 44 is mounted to the process unit 2.

Figure 36A:
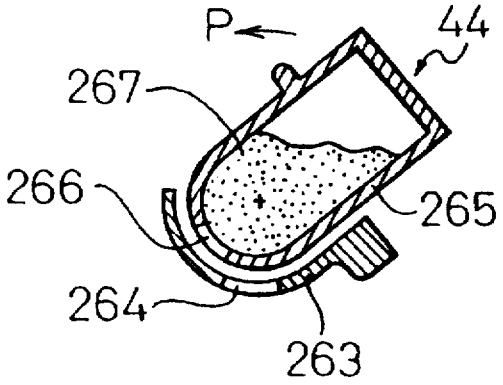
FIGS. 36(A) and 36(B) are diagrammatic views of the toner cartridge.
Figure 36B:
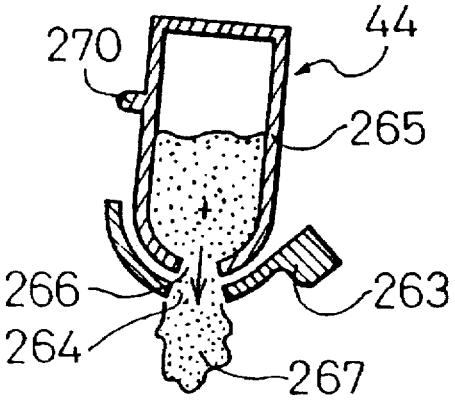

FIGS. 36(A) and (B) show a toner cartridge 44. Similarly to the embodiment shown in FIGS. 34(A) and (B), since an opening 264 of an outer cover 263 is not aligned with an opening 266 of an inner cover 265 when the toner cartridge is not yet used, no toner 267 flows out from the toner cartridge. However, when the inner cover 265 is made to rotate in the arrowed direction P, the openings 264, 266 are aligned with each other to allow the toner contained in the interior of the cartridge 44 to flow out through the openings. In this regard, if the cartridge 44 stands alone, the outer cover 263 is always biased by a spring (not shown) to occupy a position wherein the opening 264 thereof is not aligned with the opening 266 of the inner cover 265.

Figure 37A:
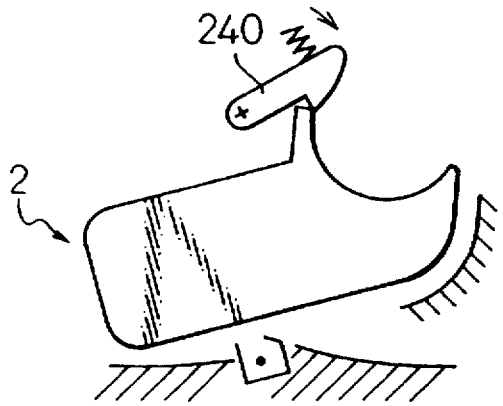
FIGS. 37(A), 37(B) and 37(C) are illustrations for explaining the operation of the other locking mechanism for the process unit.
Figure 37B:
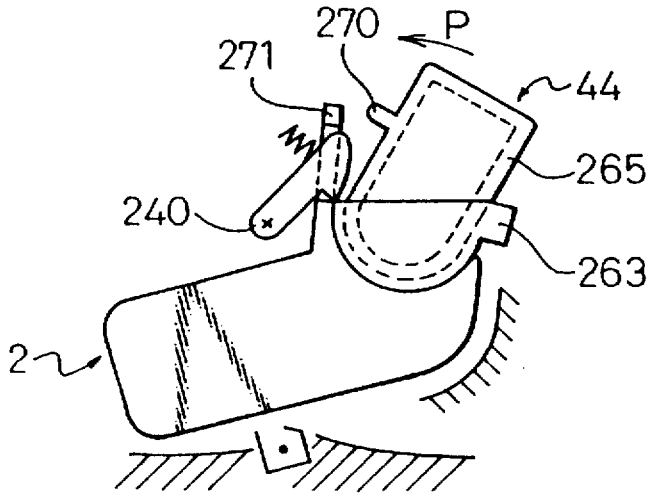
Figure 37C:
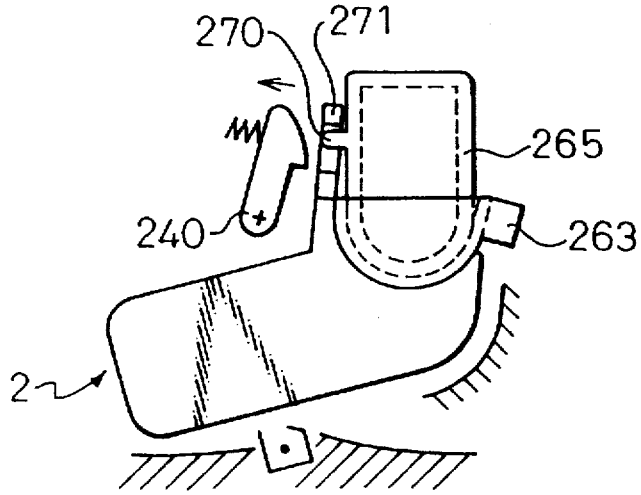

FIGS. 37(A), (B) and (C) are the time-serial illustrations of the steps for mounting the toner cartridge 44 shown in FIGS. 36(A) and (B) to the process unit 2. In a state shown in FIG. 37(A) wherein the process unit 2 is solely mounted to the printer body, the process unit 2 is locked by a hook of a locking member 240 on the printer body. In a state shown in FIG. 37(B), it is possible to mount the toner cartridge 44 to the process unit 2 only when an opening 264 of an outer cover 263 thereof is not aligned with an opening 266 of an inner cover 265. This is because, in the state shown in FIG. 37(B), a projection 270 of the toner cartridge 44 abuts to a hook of a locking member 240 on the printer body to interfere with the mounting operation. Therefore, in this state, the locking member 240 is still operative to lock the process unit 2 to the printer body. However, when the inner cover 265 of the toner cartridge 44 is made to rotate in the arrowed direction P in this state as shown in FIG. 37(C) to locate the opening 266 of the inner cover 265 to be aligned with the opening 264 of the outer cover 263, the projection 270 of the toner cartridge 44 pushes the hook of the locking member 240 to disengage the same from the locking part of the process unit 2, whereby the process unit is removable. As stated above, the process unit 2 and the toner cartridge 44 are integrally coupled with each other, and the process unit 2 can be detached from the printer body only when the toner cartridge is located at an operative position. In the operative position, the projection 270 of the toner cartridge 44 is engaged into an aperture 271 of the process unit 2 so that the toner cartridge 44 is fixedly secured to the process unit 22.

Figure 38A:
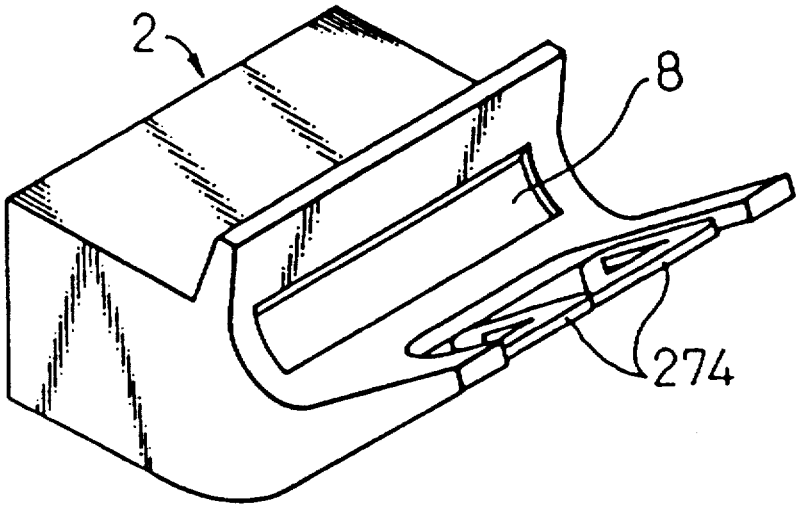
FIGS. 38(A) and 38(B) are diagrammatic views of another process unit.
Figure 38B:
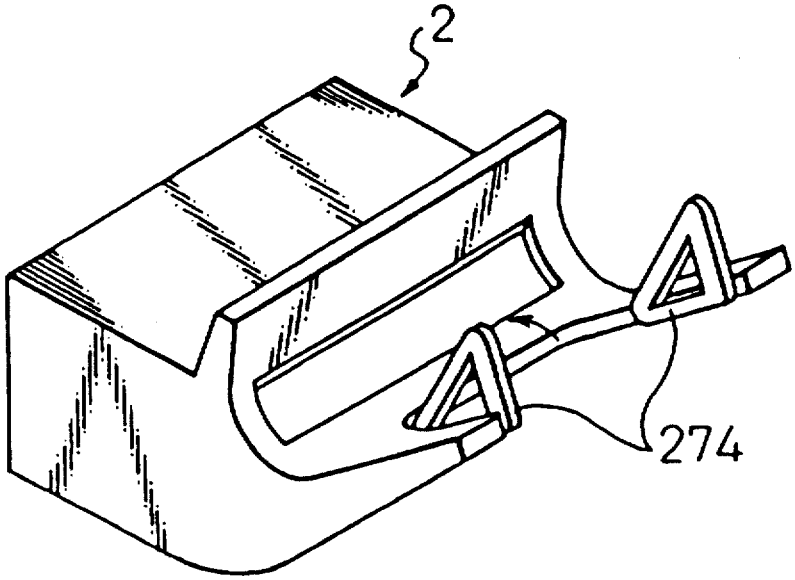

FIGS. 38(A) and (B) illustrate a further embodiment of a process unit 2 wherein a toner supply opening 8 is provided in a toner cartridge-mounting recess having a U-shaped cross-section. A pair of grips 274 are pivoted on one edge of the recess and biased by a spring or the like (not shown) normally projected into the recess as shown in FIG. 38(B). Accordingly, when the toner cartridge is mounted, these grips 274 are forcibly extended to flush with a wall of the recess as shown in FIG. 38(A).

Figure 39A:
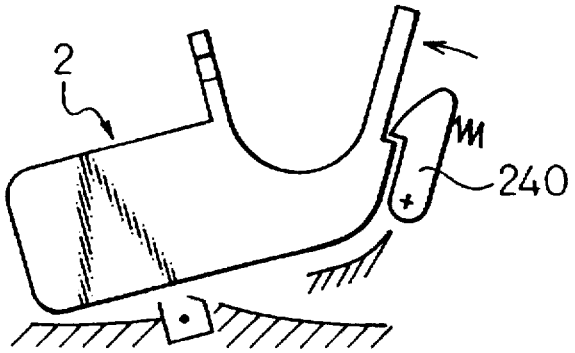
FIGS. 39(A), 39(B) and 39(C) are illustrations for explaining the operation of the process unit shown in FIG. 38.
Figure 39B:
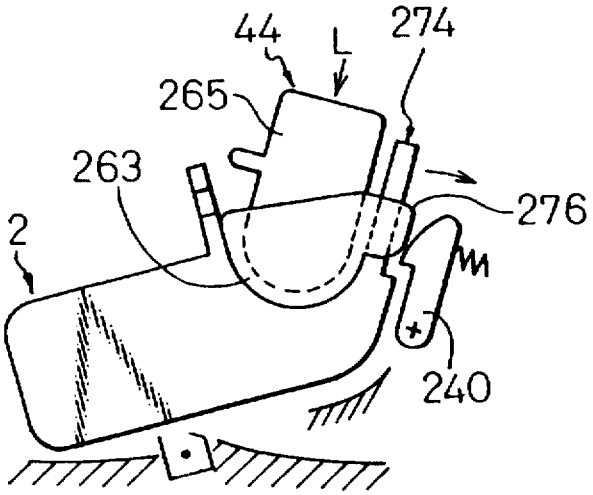
Figure 39C:
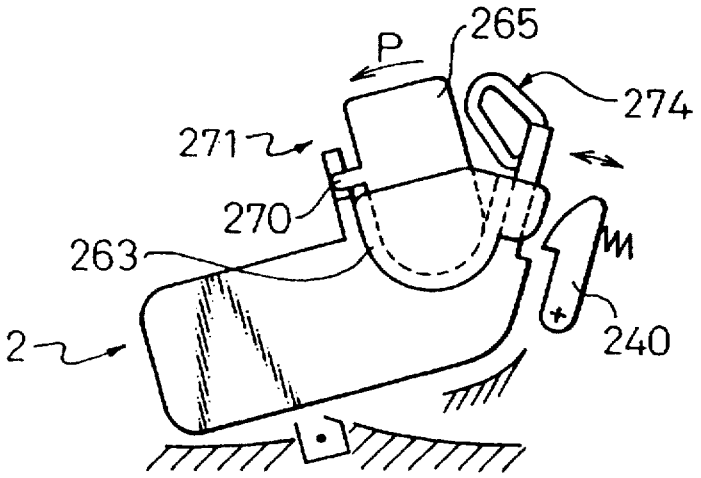

FIGS. 39(A) through (C) are the time-serial illustrations of the steps for mounting the toner cartridge 44 to the process unit 2. As shown in FIG. 39(A), in a state wherein the process unit 2 is mounted to the printer body, the process unit 2 is locked by a hook of a locking member 240 on the printer body. As shown in FIG. 39(B), when the toner cartridge 44 is mounted to the process unit 2, the grips 274 are forcibly extended as stated above and then the toner cartridge 44 is inserted in the arrowed direction L. Since an opening of an outer cover 263 is not aligned with an opening of an inner cover 265 in this state, the toner is prevented from flowing out of the toner cartridge. Also, a lock-releasing part 276 of the toner cartridge 44 pushes the hook of the locking member 240 on the printer body to release the locking state of the process unit 2 to the printer body. Then, as shown in FIG. 39(C), the inner cover 265 of the toner cartridge 44 is made to rotate in the arrowed direction P, whereby the opening of the outer cover 263 of the toner cartridge 44 is aligned with the opening of the inner cover 265, and a projection 270 of the toner cartridge 44 is engaged with an aperture 271 of the process unit 2 to prevent the toner cartridge 44 from escaping from the process unit 2. Further, the grips 274 are biased by the spring or the like (not shown) to project toward the toner cartridge 44 so that the toner cartridge 44 is prevented from rotating in the direction opposite to the arrowed direction P. Accordingly, the toner cartridge 44 is fixedly secured onto the process unit 2 in this state. Therefore, the toner cartridge 44 is removable from the printer body provided it is mounted to the process unit, but it is impossible to remove the toner cartridge 44 alone from the process unit on the printer body.

Thus, the process unit 2 is removable from the printer body only when the toner cartridge 44 is mounted thereto, and the toner cartridge 44 is removable from the process unit 2 only when the openings of the outer cover 263 and the inner cover 265 are not aligned with each other, whereby toner leakage and the contamination caused thereby are avoided during such mounting/dismounting operations.

Figure 40A:
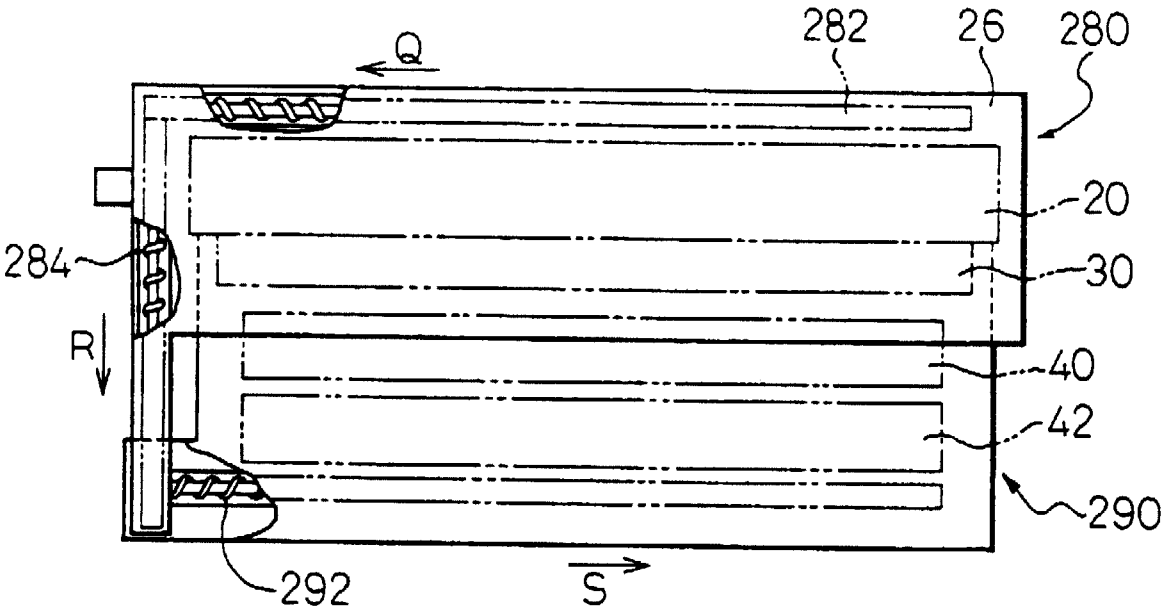
FIGS. 40(A) and 40(B) are a plan view and a side view, respectively, of a toner recycling mechanism in a process unit wherein a drum unit is combined with a developer unit.
Figure 40B:
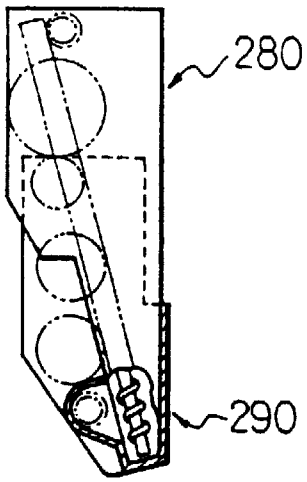
Figure 41A:
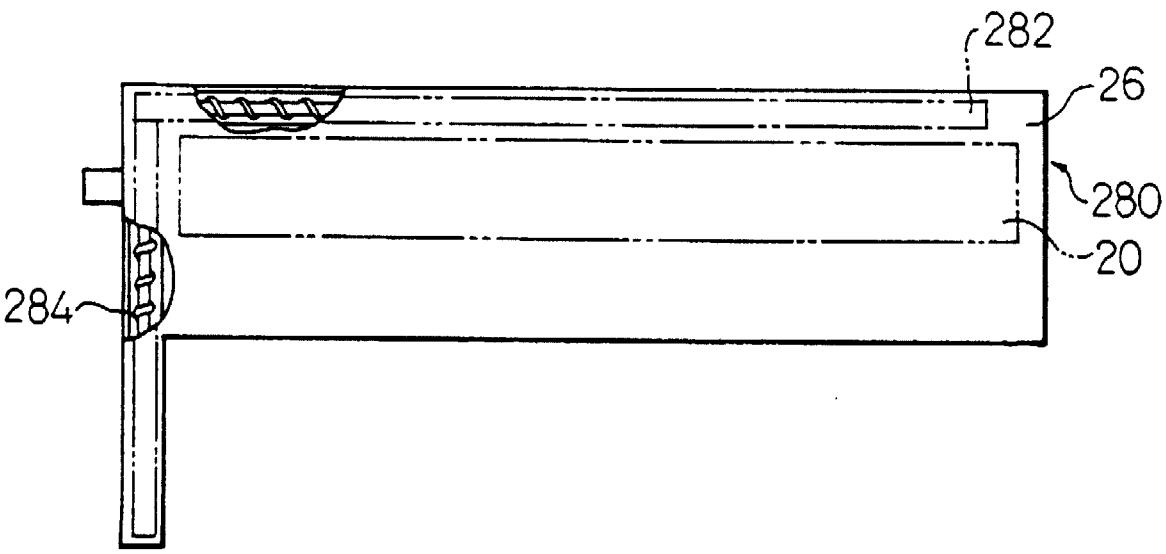
FIGS. 41(A) and 41(B) are a plan view and a side view, respectively, of the toner recycling mechanism in the drum unit.
Figure 41B:
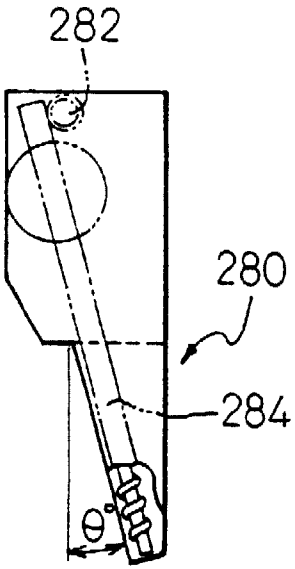
Figure 42A:
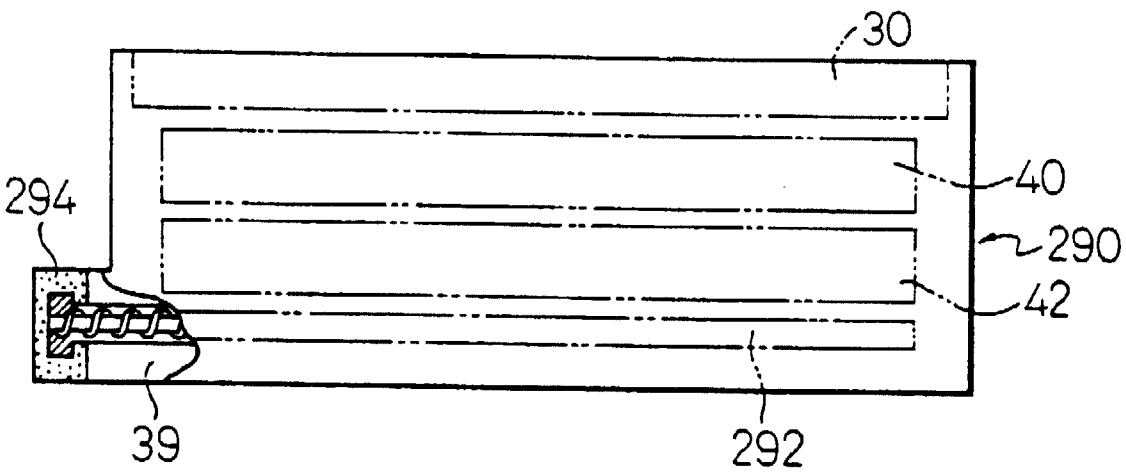
FIGS. 42(A) and 42(B) are a plan view and a side view, respectively, of the toner recycling mechanism in the developer unit.
Figure 42B:
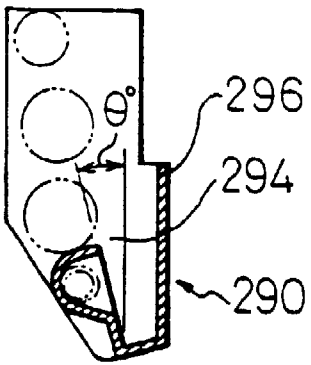

FIGS. 40 through 42 illustrate a toner recycling mechanism wherein FIG. 40(A) and (B) are a plan view and a side view of a process unit which is a combination of a drum unit 280 and a developer unit 290, FIGS. 41(A) and (B) are a plan view and a side view of the drum unit, and FIGS. 42(A) and (B) are a plan view and a side view of the developer unit. While the explanation was already made on the toner recycling mechanism itself with reference to FIGS. 6 and 7, a toner recycling mechanism will be further described in relation to a combined structure of the developer unit and the drum unit.

The drum unit 280 is constituted as a one-piece unit by a photosensitive drum 20, a cleaner 26, a precharger (not shown) or others. The drum unit 280 has a first screw 282, for recycling residual toner scraped off the photosensitive drum 20, disposed parallel to the photosensitive drum 20. One end of the first screw is laterally projected outside the drum unit 280. From a position beneath the end of the first screw 282, a second screw 284 extends along a side wall of the drum unit generally vertically to the photosensitive drum 20 while slanted upward at an angle θ° in a range between 5 and 25°. The first screw 282 is coupled with the second screw 284 via helical gears as shown in FIG. 7 to be capable of transmitting a torque therebetween. Another helical gear is also provided on the other end of the second screw 284.

The developer unit 290 is constituted as a one-piece unit by a developer roller 30, first and second agitators 40, 42, a toner returning chamber 39 or others. In the toner returning chamber 39 in this developer unit 290, a third screw 292 is provided parallel to the developer roller 30 and the agitators 40, 42, and one end thereof having a helical gear projects outside a side wall of the developer unit 290.

When the drum unit 280 and the developer unit 290 are combined together, the helical gear of the third screw 292 is positioned to be meshed from-underneath with the helical gear on the other end of the second screw 284. As described before, a toner conveying path is formed integrally with the drum unit 280 by a flexible tube or the like along the second screw 284 and joint portions between the screws. In the conveying path in a joint portion between the drum unit 280 and the developer unit 290, a seal 294 is provided for preventing the toner leakage. In this regard, the developer unit 290 is coupled to the drum unit 280 so that a guide 296 abuts on the drum unit 280.

According to the toner recycling mechanism of this embodiment, the residual toner scraped off from the photosensitive drum 20 by the cleaner 26 is conveyed by the first screw 282 leftward in the drawing in the arrowed direction Q, and transferred at the end thereof to the second screw 284 disposed underneath. Then the residual toner is conveyed obliquely upward thereby in the arrowed direction R to be transferred to the third screw 292 disposed beneath the other end of the second screw 284, which then is conveyed in the arrowed direction S to the toner returning chamber 39 and returned to the toner chamber. The drum unit 280 may be coupled to the developer unit 290 in a sliding manner in this embodiment.

Figure 43:
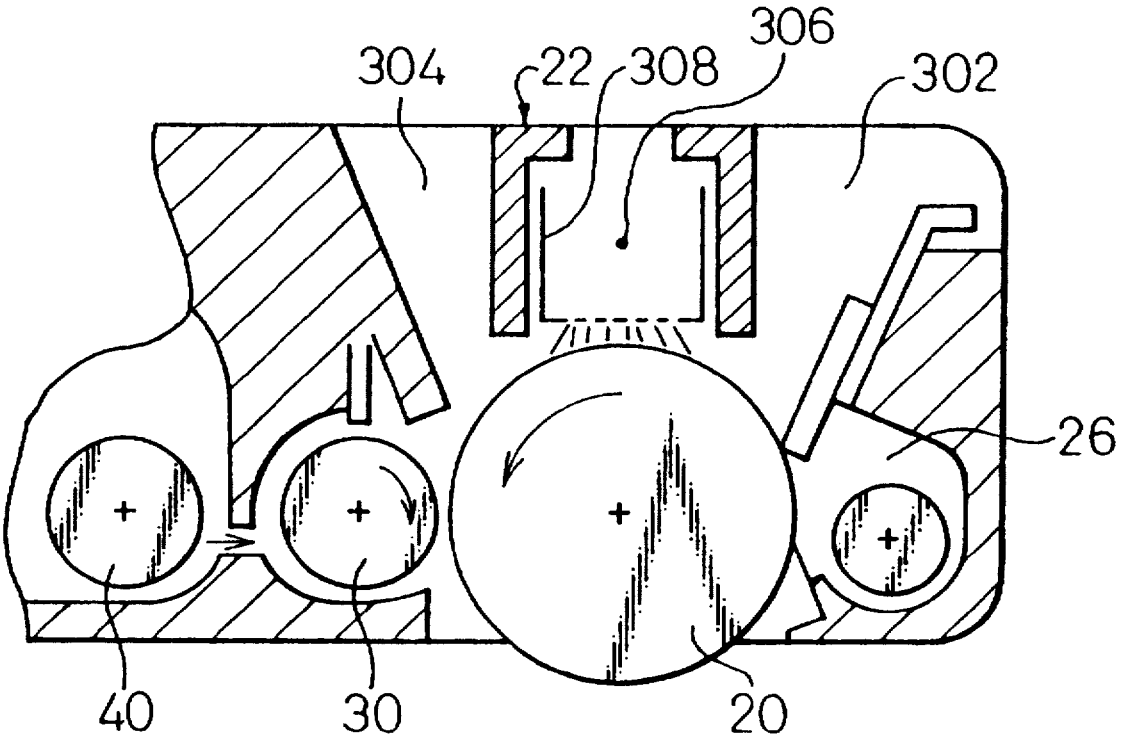
FIG. 43 is a diagrammatically sectional view illustrating an area in the vicinity of a charger in the developer unit.
Figure 44:
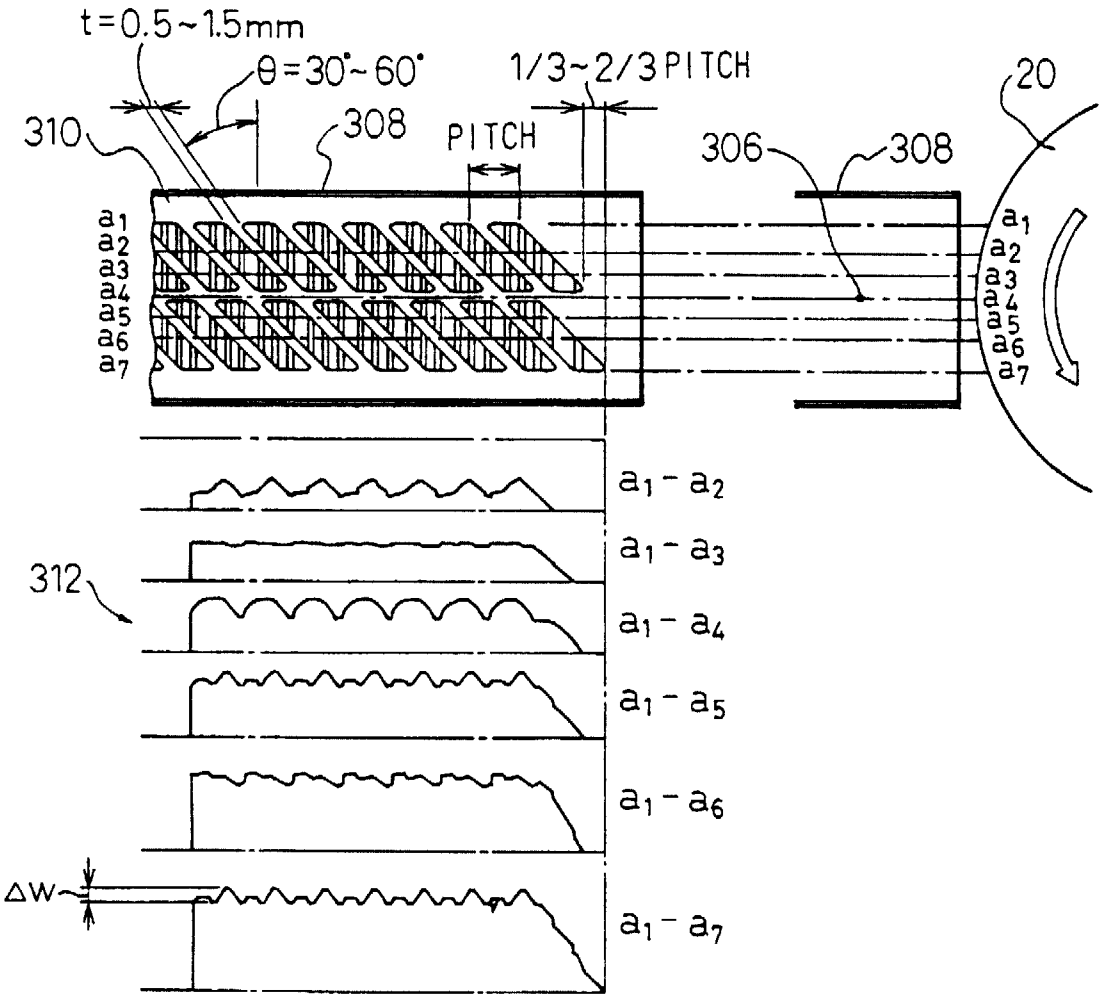
FIG. 44 is the illustration of a pattern of grid electrode in the charger.

FIG. 43 illustrates a structure in the vicinity of a precharger, i.e., a scorotron charger 22, and FIG. 44 illustrates another configuration of a grid electrode in the scorotron charger shown in FIGS. 22(A) and (B). In FIG. 43, reference numeral 20 denotes a photosensitive drum used as an image carrier, 30 a developer roller, 40 an agitator, 26 a cleaner, 302 a decharging opening, 304 an exposure opening, 306 a non-contact charging member, and 308 a grid electrode. In FIG. 44, reference numeral 20 denotes a photosensitive drum, 308 a grid electrode, 306 a non-contact charging member, 310 a pattern of grid electrode apertures, and 312 charging patterns $a_1$–$a_7$ based on the pattern of apertures, particularly charging patterns in the respective positions of the pattern and those overlapping the same.

The grid electrode 308 is formed by a pressing process. A plurality of apertures of the same shape are arranged in the axial direction of the photosensitive drum 20 to form a row which is repeated in the circumferential direction to form a plurality of rows in the embodiments shown in FIGS. 22(A) and (B). While, according to the embodiment shown in FIG. 44, a plurality of rows (only two are shown) are also formed in the circumferential direction of the photosensitive drum 20, but the apertures in the respective row is shifted, for example, by one third through two thirds of an arrangement pitch relative to those in the adjacent row. The aperture 310 itself is of a parallelopipedon shape having an inclination ($\theta$) in a range between about 30° and 60° and a distance (t) is in a range between 0.5 mm and 1.5 mm between adjacent apertures.

By such a pattern 310 of the apertures, it is possible to minimize the irregularity in a width of the aperture in the axial direction of the photosensitive drum 20 and reduce the charging irregularity on the photosensitive drum 20 as shown in the charging patterns 312, resulting in a favorable printing quality. Also, since the pattern 310 is formed by a plurality of rows, it is possible to obtain a grid electrode 308 at a lower cost, having an improved strength of the grid member.

Figure 45:
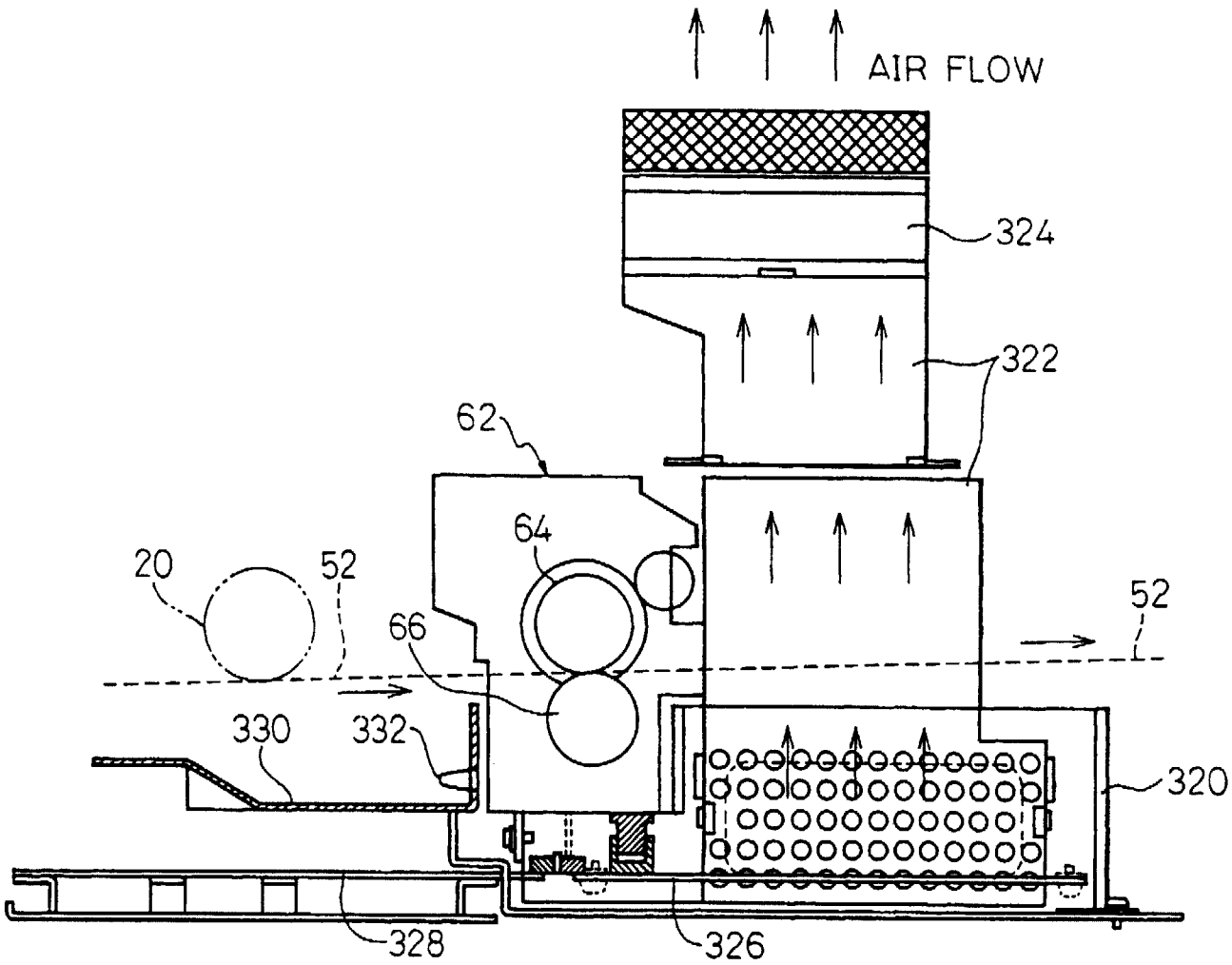
FIG. 45 is the illustration of a combination of a fixing device and an electric power unit.

FIG. 45 shows an assembly of a fixing unit 62 and a power source unit 320. Since the fixing unit and the power source unit generate a considerable amount of heat, there is a problem, if they are structured as separate units, in that means for cooling the same, such as the arrangement of cooling ducts or others, as well as the electric connection between both the units become complicated, must be individually attached/detached for the purpose of maintenance or replacement, resulting in the increase in the maintenance cost.

According to this embodiment, the fixing unit 62 and the power source unit 320 are united together to be a single unit. In FIG. 45, reference numeral 20 denotes a photosensitive drum, 52 a paper on which a toner image is transferred, 62 a fixing unit, 320 a power source unit, 322 a heat-exhausting duct, 324 a heat-exhausting fan, 326 a first printed circuit board, 328 a second printed circuit board, 330 a frame of the apparatus, and 332 a positioning pin.

As illustrated, the fixing unit 62, including a pair of heat rollers 64, 66, is mounted on the power source unit 320 adjacent to an electric source carried thereon. The power supply is directly conducted from the power source unit 320 to the fixing unit 62 via a connector or a cable (not shown). The upper part of the heat exhausting duct 322 provided on the power source unit 320 extends to the fixing unit 62 so that the heat exhausting duct 322 and the heat exhausting fan 324 can be used for cooling not only the power source unit 320 but also the fixing unit 62.

This integral unit is mounted to the printer body by engaging the positioning pin 332 into a corresponding hole of the frame 330 whereby the fixing unit 62 is located at a proper position relative to the printer body and the direct electric connection of the unit is achieved with the second printed circuit board 328 on the printer. In this regard, the first printed circuit board 326 is attached to the integral unit.

The present invention has the following advantages:

(1) Since the front end of the paper can be assuredly caught by a pick roller even if the number of paper sheets in a paper cassette falls, it is possible to avoid erroneous picking. Also, since a pick roller and a separation pad are not in contact with the front end of the paper for a long time, it is possible to prevent the pick roller and/or the separation pad from being deformed, whereby the durability thereof is improved.

(2) Since the residual toner is directly returned from a cleaner to a toner chamber in a development device, it is possible to reduce the inclination angle of a toner recycling mechanism, whereby the residual toner is prevented from dwelling on the bottom of the cleaner to improve the toner reuse efficiency.

(3) Since the configuration of a partitioning member defining a carrier chamber is optimized, it is possible to equalize the axial distribution of the toner density in the widthwise direction of a development roller, whereby a desirable image quality without toner unevenness is obtainable.

We claim:

1. An electrophotographic image forming apparatus comprising:

an electrostatic latent image carrying body;

means for uniformly electrifying said carrying body;

means for conducting an optical exposure on said carrying body to form an electrostatic latent image thereon;

means for developing said electrostatic latent image to form a toner image on said carrying body;

means for transferring said toner image from said carrying body onto a printing sheet;

means for fixing said toner image to said printing sheet;

means for cleaning to remove residual toner from said carrying body;

means for returning said residual toner removed by said cleaning means to said developing means; and a power supply source of said apparatus, said power supply source being a single unit with said fixing means.

2. An electrophotographic image forming apparatus comprising:

an electrostatic latent image carrying body;

means for uniformly electrifying said carrying body;

means for conducting an optical exposure on said carrying body to form an electrostatic latent image thereon;

means for developing said electrostatic latent image to form a toner image on said carrying body;

means for transferring said toner image from said carrying body onto a printing sheet;

means for fixing said toner image to said printing sheet, said fixing means comprising a pair of rollers, at least one of the rollers being a heat roller;

means for cleaning to remove residual toner from said carrying body;

means for returning said residual toner removed by said cleaning means to said developing means; and a power supply source of said apparatus, said power supply source being a single unit with said fixing means, in such a manner that said single unit can be mounted to a printer body of said apparatus as a single unitary unit separated from the other means.

* * * * *